US008117876B2

(12) United States Patent
Mathachan

(10) Patent No.: US 8,117,876 B2
(45) Date of Patent: Feb. 21, 2012

(54) PROGRAMMABLE LOCK CYLINDER ASSEMBLY

(75) Inventor: Sajil John Mathachan, Dharwad (IN)

(73) Assignee: Schlage Lock Company LLC, Carmel, IN (US)

( * ) Notice: Subject to any disclaimer, the term of this patent is extended or adjusted under 35 U.S.C. 154(b) by 507 days.

(21) Appl. No.: 12/138,950

(22) Filed: Jun. 13, 2008

(65) Prior Publication Data

US 2008/0314106 A1 Dec. 25, 2008

Related U.S. Application Data

(60) Provisional application No. 60/934,353, filed on Jun. 13, 2007.

(51) Int. Cl.
*E05B 27/04* (2006.01)
*E05B 29/04* (2006.01)

(52) U.S. Cl. ..... 70/492; 70/383; 70/384; 70/493; 70/495

(58) Field of Classification Search ..... 70/337–343, 70/368, 382–385, 491–496
See application file for complete search history.

(56) References Cited

U.S. PATENT DOCUMENTS

| | | | |
|---|---|---|---|
| 1,494,765 | A | 5/1924 | Barrett |
| 1,514,318 | A | 11/1924 | Henriksson |
| 1,564,556 | A | 12/1925 | Goodfellow |
| 1,965,336 | A | 7/1934 | Gerald |
| 3,320,781 | A | 5/1967 | Hill |
| 3,499,302 | A | 3/1970 | Spain et al. |
| 3,589,153 | A | 6/1971 | Hill |
| 3,983,728 | A | 10/1976 | Phillips |
| 3,991,596 | A | 11/1976 | Gartner |
| 3,999,413 | A | 12/1976 | Raymond et al. |
| 4,122,694 | A | 10/1978 | Gretler |
| 4,142,389 | A | 3/1979 | Bahry et al. |
| 4,231,242 | A | 11/1980 | Hill et al. |

(Continued)

FOREIGN PATENT DOCUMENTS

| | | |
|---|---|---|
| EP | 0 226 252 | 6/1987 |

(Continued)

OTHER PUBLICATIONS

International Search Report for PCT/US2008/007392 dated Mar. 12, 2009.

*Primary Examiner* — Suzanne Barrett
*Assistant Examiner* — Christopher Boswell
(74) *Attorney, Agent, or Firm* — RatnerPrestia

(57) ABSTRACT

A programmable lock cylinder assembly comprising a lock housing and a cylinder plug mounted for rotation within the housing. A set of rack pins are positioned in the cylinder plug and moveable between a locked position and an unlocked position. A set of tongue pins are positioned in the cylinder plug and extend across the keyway. Each tongue pin is selectively engagable with a respective rack pin. A re-combinating member is engaged with the tongue pins and moveable between a first position wherein the tongue pins are engaged with the rack pins and a second position wherein the tongue pins are disengaged from the rack pins. A reset actuator is positioned within the cylinder plug and moveable between an engaged position wherein the re-combinating member position is locked relative to the cylinder plug and a non-engaged position wherein the re-combinating member position is moveable relative to the cylinder plug.

23 Claims, 32 Drawing Sheets

U.S. PATENT DOCUMENTS

| | | | | |
|---|---|---|---|---|
| 4,290,287 | A | 9/1981 | Peppard | |
| 4,376,382 | A * | 3/1983 | Raymond et al. | 70/383 |
| 4,377,082 | A | 3/1983 | Wolter | |
| 4,453,432 | A | 6/1984 | Widen | |
| 4,712,399 | A | 12/1987 | Mattossovich | |
| 4,741,188 | A * | 5/1988 | Smith | 70/383 |
| 4,836,002 | A | 6/1989 | Monahan | |
| 4,966,021 | A | 10/1990 | Boag | |
| 5,325,690 | A | 7/1994 | Adler et al. | |
| 5,495,733 | A | 3/1996 | Yen et al. | |
| 5,502,990 | A | 4/1996 | Hirvi | |
| 5,718,136 | A | 2/1998 | Aldieri et al. | |
| 6,076,386 | A | 6/2000 | Etchells et al. | |
| 6,119,495 | A | 9/2000 | Loreti | |
| 6,477,876 | B1 | 11/2002 | Kim | |
| 6,578,396 | B2 | 6/2003 | Field et al. | |
| 6,681,609 | B1 | 1/2004 | Preddey | |
| 6,860,131 | B2 | 3/2005 | Armstrong et al. | |
| 6,862,909 | B2 | 3/2005 | Armstrong et al. | |
| 6,871,520 | B2 | 3/2005 | Armstrong et al. | |
| 6,935,146 | B1 | 8/2005 | Lin | |
| 6,959,569 | B2 | 11/2005 | Strader et al. | |
| 6,973,813 | B2 | 12/2005 | Erdely | |
| 6,983,630 | B2 | 1/2006 | Eden, Jr. et al. | |
| 7,007,528 | B2 | 3/2006 | Chong et al. | |
| 7,028,517 | B2 | 4/2006 | Divito | |
| 7,114,357 | B2 | 10/2006 | Armstrong et al. | |
| 7,117,701 | B2 | 10/2006 | Armstrong et al. | |
| 7,162,900 | B1 | 1/2007 | Lu | |
| 7,162,901 | B2 | 1/2007 | Williams | |
| 7,181,937 | B2 | 2/2007 | Keller | |
| 7,181,938 | B2 | 2/2007 | Price | |
| 7,207,200 | B2 | 4/2007 | Eden, Jr. et al. | |
| 7,213,429 | B2 | 5/2007 | Armstrong et al. | |
| 7,225,651 | B2 | 6/2007 | Edwards et al. | |
| 7,234,331 | B2 | 6/2007 | Armstrong et al. | |
| 7,240,523 | B2 | 7/2007 | Johansson et al. | |
| 7,240,525 | B2 | 7/2007 | Gil | |
| 7,290,418 | B2 | 11/2007 | Herdman | |
| 7,308,811 | B2 | 12/2007 | Armstrong et al. | |
| 7,322,219 | B2 | 1/2008 | Armstrong et al. | |
| 7,340,929 | B1 | 3/2008 | Christopoulos | |
| 7,448,239 | B1 * | 11/2008 | Huang et al. | 70/383 |
| 7,448,240 | B1 * | 11/2008 | Huang et al. | 70/383 |
| 7,526,935 | B2 * | 5/2009 | Huang et al. | 70/383 |
| 7,584,635 | B2 * | 9/2009 | Gan et al. | 70/383 |
| 7,624,606 | B1 * | 12/2009 | Huang et al. | 70/383 |
| 7,628,048 | B2 * | 12/2009 | Huang et al. | 70/383 |
| 7,634,930 | B2 * | 12/2009 | Boesel et al. | 70/383 |
| 2006/0059965 | A1 | 3/2006 | Benstead | |
| 2006/0112748 | A1 | 6/2006 | Benstead | |
| 2007/0017264 | A1 | 1/2007 | Seliber | |
| 2007/0028658 | A1 | 2/2007 | Widen | |
| 2007/0051147 | A1 | 3/2007 | Widen | |
| 2007/0062230 | A1 | 3/2007 | Preddey | |
| 2007/0089468 | A1 | 4/2007 | Chong et al. | |
| 2007/0101782 | A1 | 5/2007 | Shen | |
| 2007/0186601 | A1 | 8/2007 | Lin | |
| 2007/0193317 | A1 | 8/2007 | Herdman | |
| 2007/0271976 | A1 | 11/2007 | Dalton et al. | |
| 2007/0289346 | A1 | 12/2007 | Hyatt, Jr. | |
| 2008/0011033 | A1 | 1/2008 | Chong et al. | |
| 2008/0078224 | A1 | 4/2008 | Wheatland et al. | |
| 2008/0092611 | A1 | 4/2008 | Armstrong et al. | |
| 2008/0163657 | A1 | 7/2008 | Dickhans et al. | |

FOREIGN PATENT DOCUMENTS

| | | |
|---|---|---|
| EP | 1 752 601 | 2/2007 |
| WO | WO 98/40589 | 9/1998 |
| WO | WO 2006/010080 | 1/2006 |
| WO | WO 2006/033864 | 3/2006 |

* cited by examiner

PROGRAMMABLE LOCK CYLINDER ASSEMBLY

BACKGROUND OF THE INVENTION

The present invention relates to lock cylinder assemblies. More particularly, the present invention relates to a lock cylinder assembly that may be reprogrammed without removing the cylinder plug.

When reprogramming a lock cylinder using a traditional cylinder design, the user is required to remove the cylinder plug from the cylinder body and replace the appropriate pins so that a new key can be used to unlock the cylinder. This typically requires the user to remove the cylinder mechanism from the lockset and then disassemble the cylinder to some degree to remove the plug and replace the pins. This requires a working knowledge of the lockset and cylinder mechanism and is usually only performed by locksmiths or trained professionals. Additionally, the process usually employs special tools and requires the user to have access to pinning kits to interchange pins and replace components that can get lost or damaged in the reprogramming process.

SUMMARY OF THE INVENTION

In at least one aspect, the present invention provides a programmable lock cylinder assembly comprising: a lock housing having a body defining a tubular opening and a cylinder plug having a body mounted for rotation within the tubular opening. The cylinder plug includes a keyway extending therein. A set of rack pins are positioned in the cylinder plug and moveable between a locked position wherein the cylinder plug is rotationally locked relative to the housing and an unlocked position wherein the cylinder plug is rotational relative to the housing. A set of tongue pins are positioned in the cylinder plug and extend across the keyway. Each tongue pin is selectively engagable with a respective rack pin. A re-combinating member is engaged with the tongue pins and moveable between a first position wherein the tongue pins are engaged with the rack pins and a second position wherein the tongue pins are disengaged from the rack pins. A reset actuator is positioned within the cylinder plug and moveable between an engaged position wherein the re-combinating member position is locked relative to the cylinder plug and a non-engaged position wherein the re-combinating member position is moveable relative to the cylinder plug.

In another aspect, the present invention includes at least a first subset of rack pins and a second subset of rack pins. The first subset of rack pins have at least two operable bitting configurations and the second subset of rack pins have a different bitting configuration such that the lock cylinder assembly is master keyable.

DETAILED DESCRIPTION OF THE INVENTION

Figure 1:
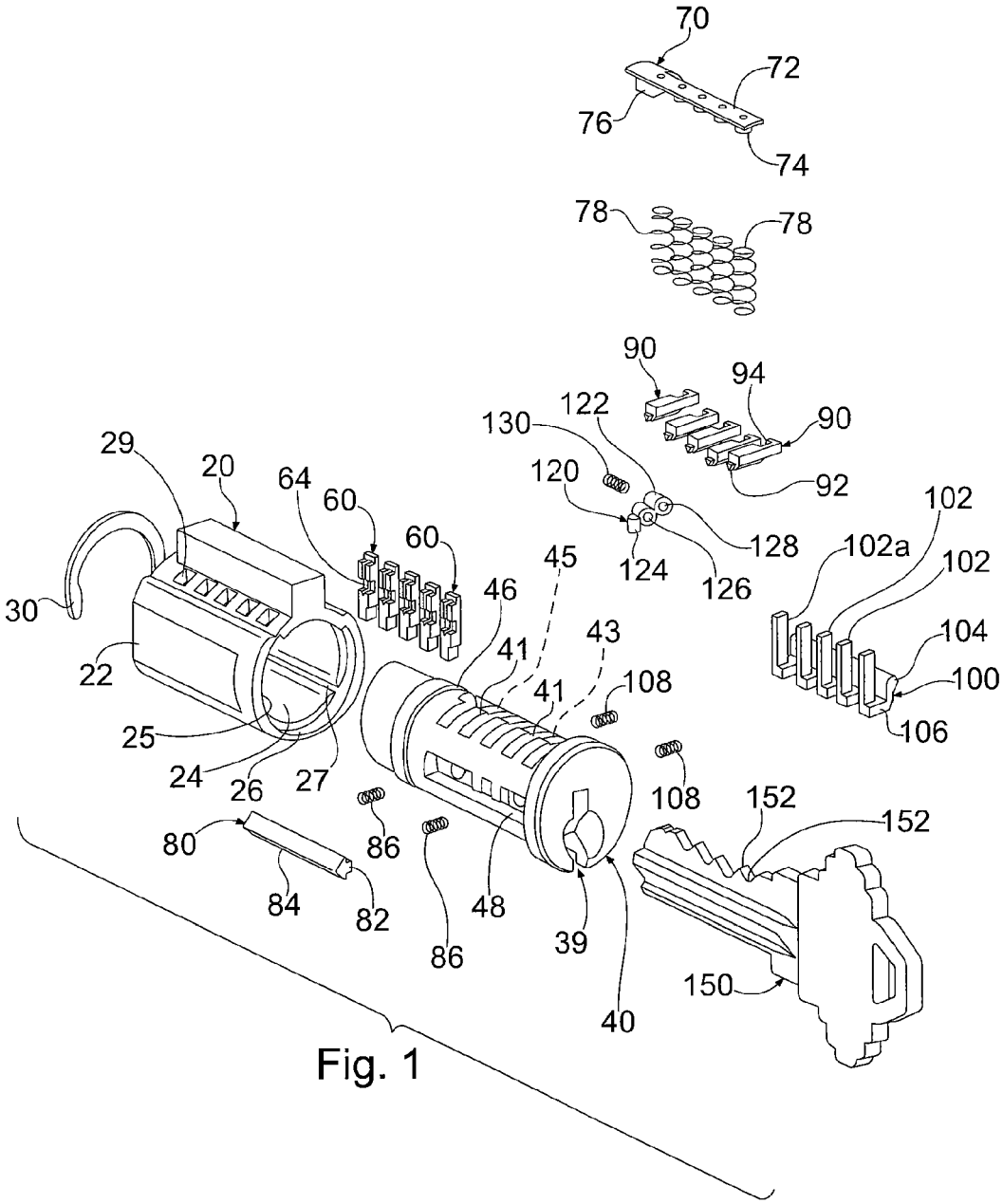
FIG. 1 is an exploded isometric view of a programmable lock cylinder assembly according to a first embodiment of the invention.

Although the invention is illustrated and described herein with reference to specific embodiments, the invention is not intended to be limited to the details shown. Rather, various modifications may be made in the details within the scope and range of equivalents of the claims and without departing from the invention.

A programmable lock cylinder assembly 10 in accordance with a first embodiment of the invention is illustrated and described with reference to FIGS. 1-28. Referring to FIGS. 1-9, the programmable lock assembly 10 generally comprises a lock housing 20 and a cylinder plug 40. The lock housing 20 includes a body 22 defining a generally tubular opening 24 extending the length thereof. The tubular opening 24 is configured to receive the cylindrical body 42 of the cylinder plug 40 and may include a shoulder 26 about the opening 24 which engages a flange 44 on one end of the cylinder plug 40. Referring to FIG. 2, the cylinder plug 40 preferably extends out the opposite end of the housing 20 and is configured for connection to an output mechanism (not shown) for transmitting force from the cylinder plug 40 to one or more elements connected to the lock cylinder assembly 10. The output mechanism can take a number of different forms, including without limitation, a lever, drive shaft, coupling, cam, or other element mounted to the lock cylinder assembly 10. The present lock cylinder assembly may be utilized in any desired application. In the illustrated embodiment, a snap ring 30 engages a groove 46 in the cylinder body 42 to retain the lock cylinder assembly 10 in the assembled state illustrated in FIG. 2.

Figure 2:
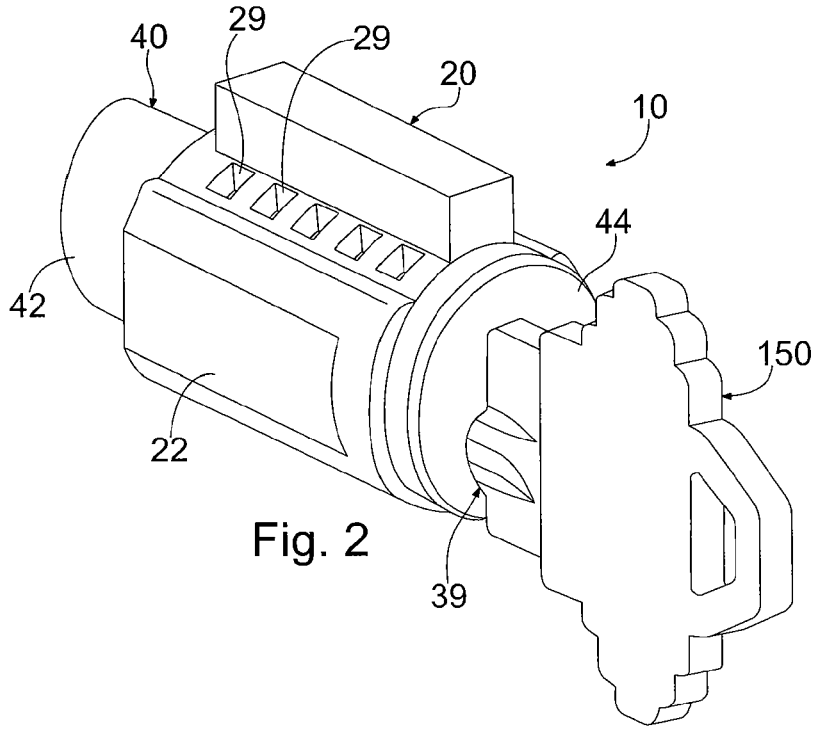
FIG. 2 is an assembled isometric view of the programmable lock cylinder assembly of FIG. 1 with a key inserted therein.
Figure 3:
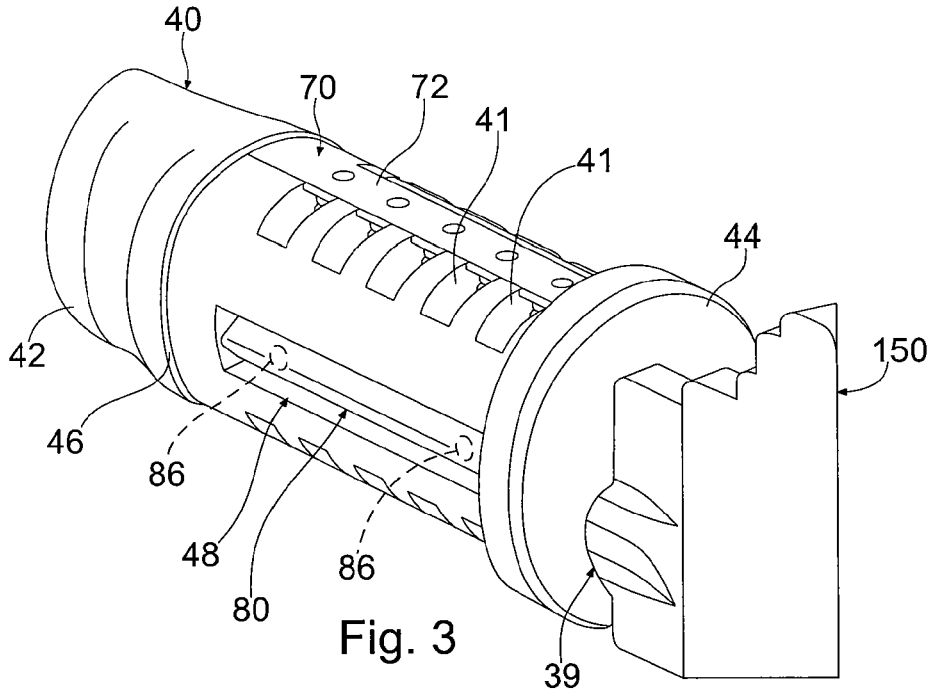
FIG. 3 is an isometric view similar to FIG. 2 with the lock housing removed and the sidebar shown translucently.
Figure 4:
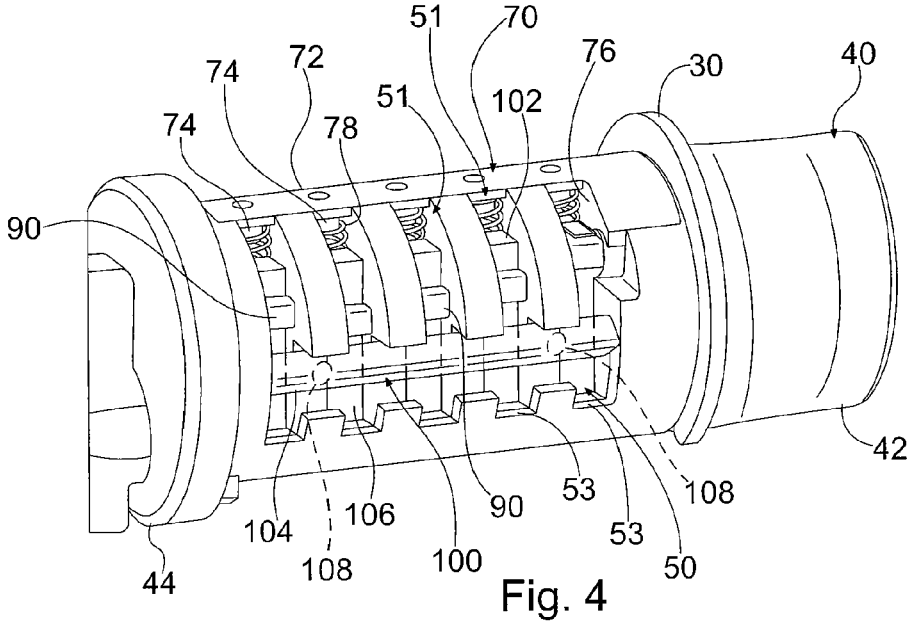
FIG. 4 is a right-side isometric view of the lock cylinder plug with the re-combinating sidebar shown translucently.
Figure 5:
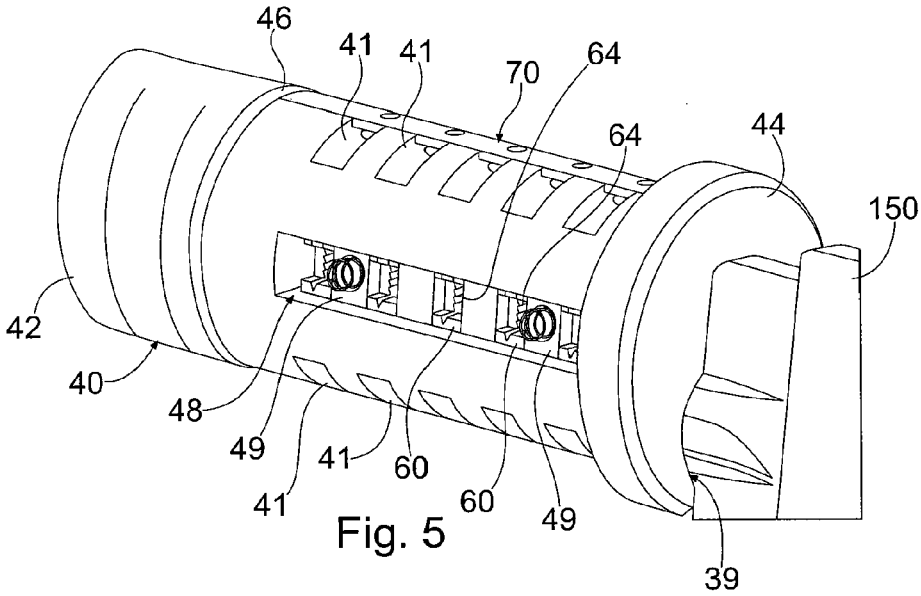
FIG. 5 is a left-side isometric view of the lock cylinder plug with the locking sidebar removed.
Figure 7:
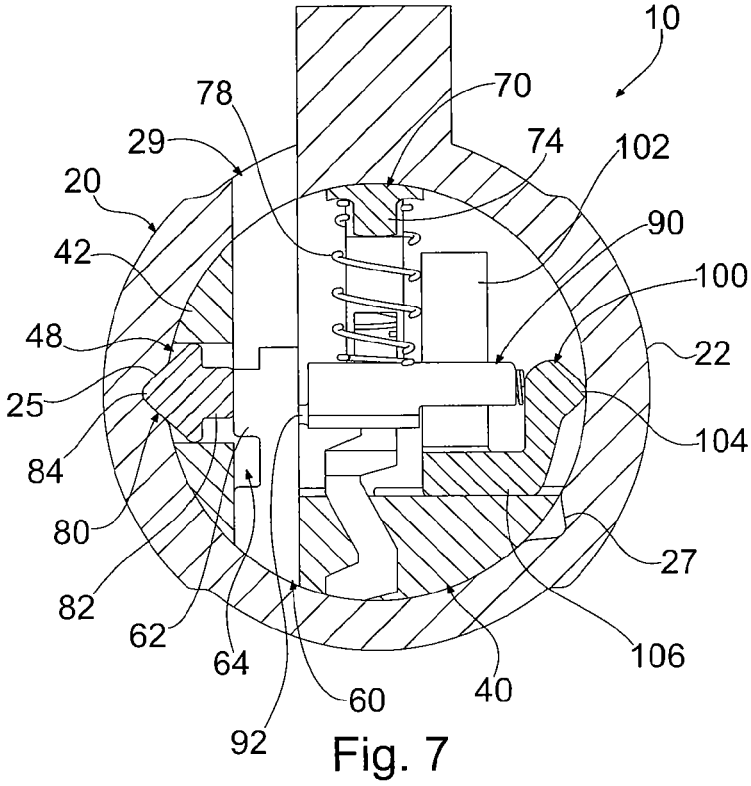
FIG. 7 is a cross-sectional view along line 7-7 in FIG. 2 with the lock cylinder assembly in a home position.

Referring to FIGS. 1 and 7, the housing body 22 includes a pair of tapered groove 25 and 27 extending along the inside surface of the opening 24. As explained in greater detail hereinafter, a sidebar 80 extends from the cylinder plug 40 and engages the tapered groove 25 to maintain the cylinder plug 40 rotationally locked relative to the housing 20 unless a proper key is positioned in the keyway 39 of the cylinder plug 40. The tapered groove 27 facilitates reprogramming of the lock cylinder assembly 10, as described in more detail hereinafter.

Figure 8:
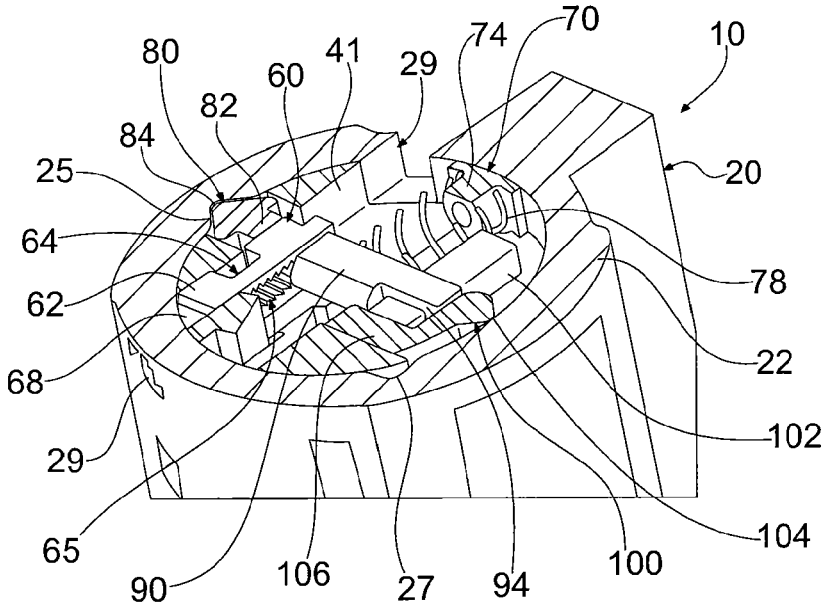
FIG. 8 is an isometric view of the lock cylinder assembly as shown in FIG. 7.

Referring to FIGS. 1 and 8, the housing body 22 may include a plurality of through bores 29 which align with rack pin bores 41 of the cylinder plug 40 when the cylinder plug 40 is positioned in a home position. The through bores 29 are configured to receive a portion of an associated rack pin 60, as described hereinafter, to further maintain the cylinder plug 40 rotationally locked relative to the housing 20 unless a proper key is positioned in the keyway 39 of the cylinder plug 40. Desirably, through bores 29 are provided on the upper and lower surfaces, in the illustrated orientation, such that the lock cylinder assembly 10 may be provided with upper and lower rack pins, if desired, for operation with a key having teeth on its upper and lower surfaces.

Referring to FIGS. 1, 3 and 5-8, the rack pin bores 41 extend substantially parallel to the keyway 39 of the cylinder plug 40. Each rack pin bore 41 is configured to receive and guide the axial movement of a rack pin 60. Each rack pin bore 41 desirably extends completely through the cylinder plug 40 such that the associated rack pin 60 may be configured to be moved upward or downward into engagement with an associated through bore 29, however, such is not required. Alternatively, the rack pin bores 41 may only extend from one surface of the cylinder plug body 42, or may even be completely internal within the cylinder plug body 42 such that the rack pins do not extend from the cylinder plug 40.

Referring to FIGS. 1, 3, 5 and 7, a sidebar opening 48 extends through a side surface of the cylinder body 42 in communication with the rack pin bores 41. The sidebar opening 48 is sized to receive a sidebar 80 such that a tapered portion 84 of the sidebar 80 is radially extendable from the cylinder plug 40. In the home position illustrated in FIG. 7, the tapered portion 84 extends from the cylinder plug 40 and is engaged in the tapered groove 25 to rotationally lock the cylinder plug 40 relative to the housing 20. One or more springs 86 are positioned between a rail portion 82 of the sidebar 80 and internal portions 49 of the cylinder body 42 to bias the sidebar radially outward.

Figure 9:
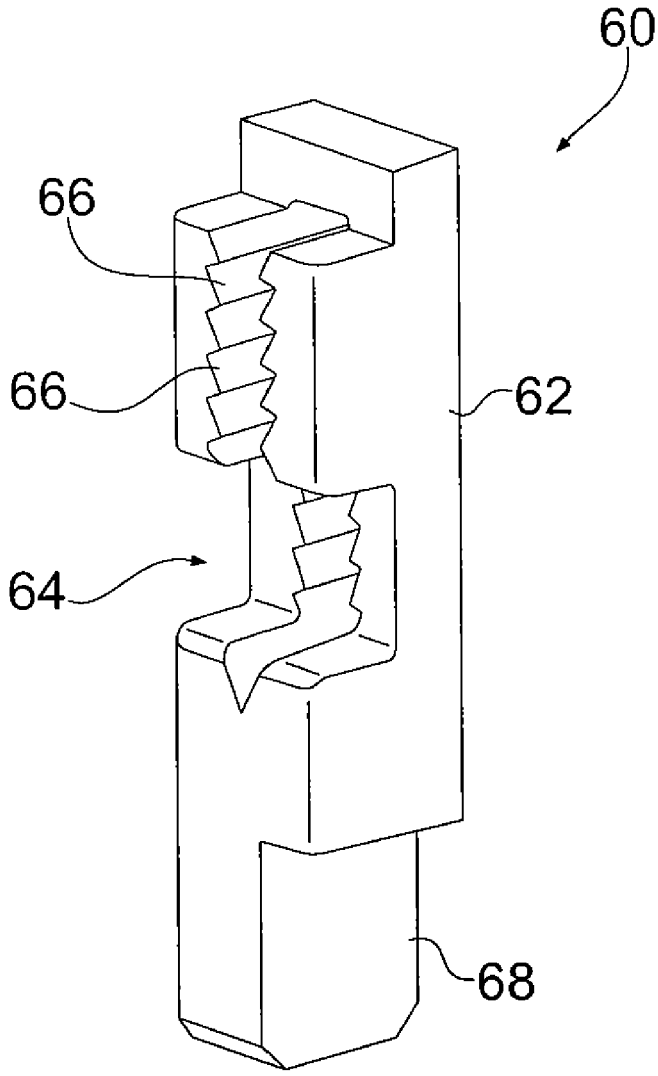
FIG. 9 is an isometric view of a rack pin in accordance with a first embodiment of the invention.

The sidebar 80 is prevented from being moved radially inward, and thereby unlocking the lock, by the rack pins 60 unless a proper key is positioned in the keyway 39. An exemplary rack pin 60 is illustrated in FIG. 9. The exemplary rack pin 60 includes an elongate body 62 generally having a width slightly less than the width of an associated rack pin bore 41 such that the rack pin 60 is axially movable therein. In the present embodiment, an end 68 of the rack pin 60 has a reduced width and is configured to be received in a corresponding housing through bore 29. The rack pin 60 includes a plurality of engagement passages 66 which facilitate programming of the lock cylinder assembly 10 as will be described in more detail hereinafter.

Figure 10:
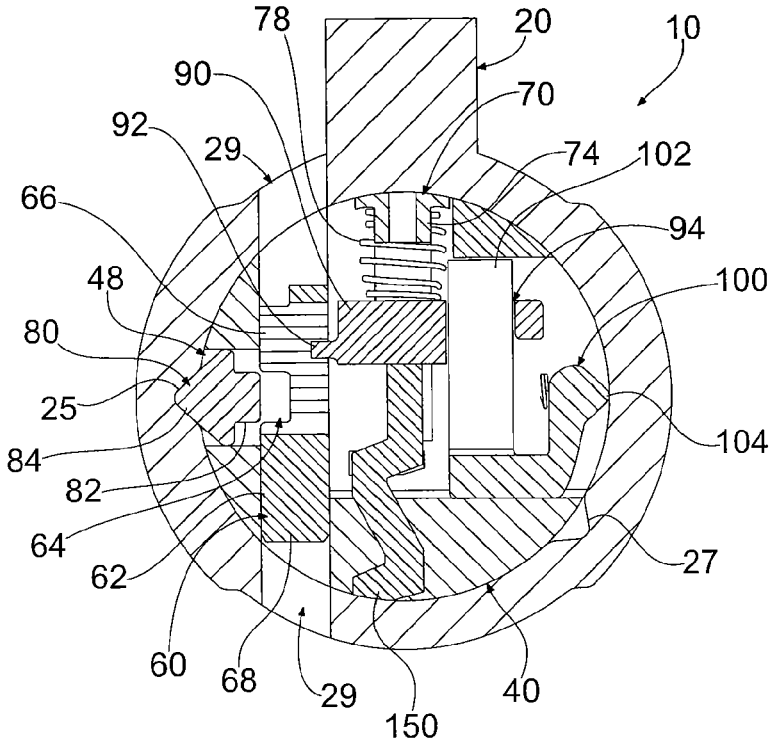
FIG. 10 is a cross-sectional view similar to FIG. 7 with a key inserted into the lock cylinder assembly.
Figure 11:
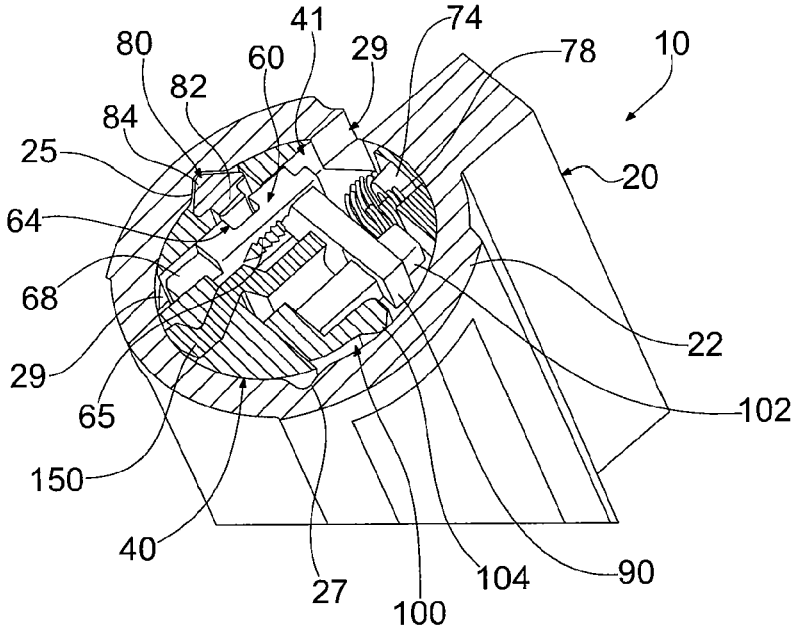
FIG. 11 is an isometric view of the lock cylinder assembly as shown in FIG. 10.
Figure 12:
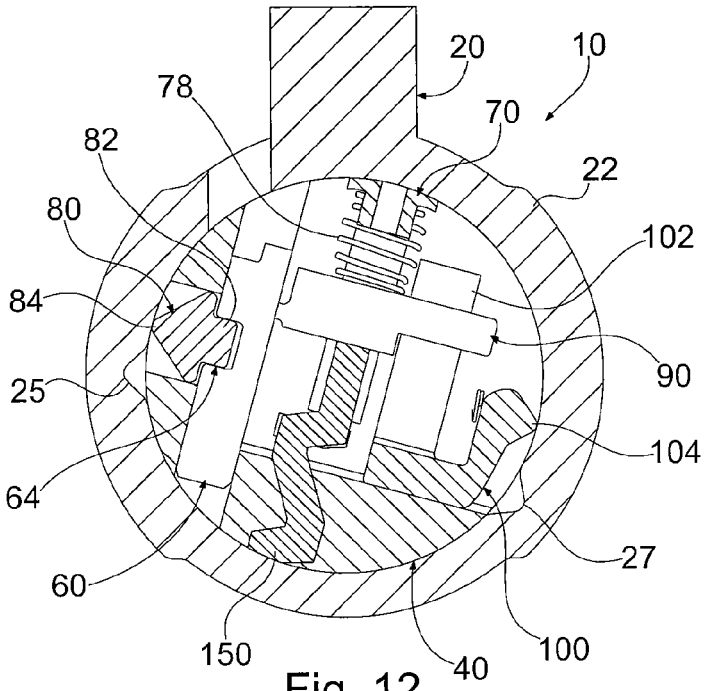
FIG. 12 is a cross-sectional view similar to FIG. 7 with a key inserted into the lock cylinder assembly and the cylinder plug rotated to an unlock position.
Figure 13:
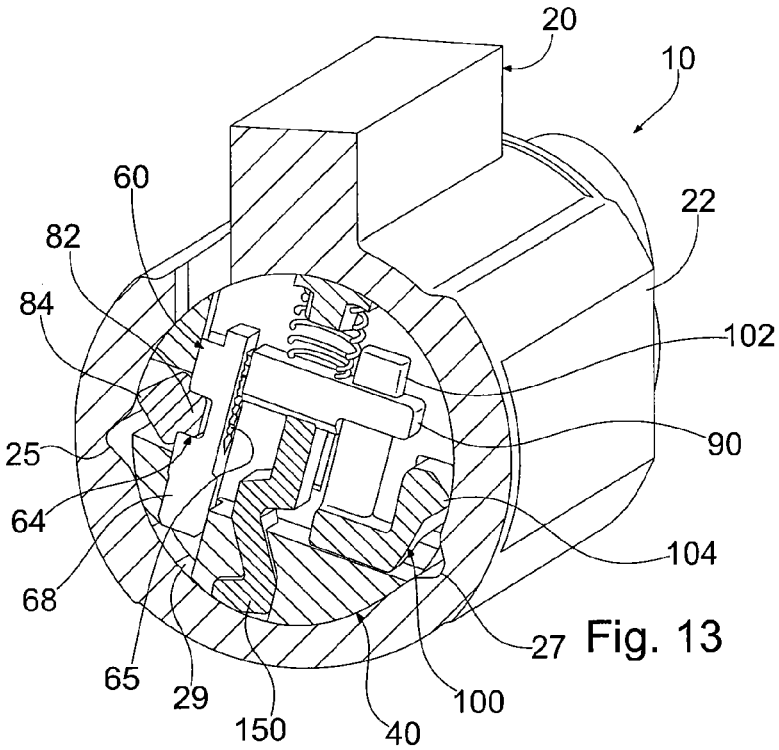
FIG. 13 is an isometric view of the lock cylinder assembly as shown in FIG. 12.

The rack pin 60 also includes a sidebar notch 64 configured to receive the rail portion 82 of the sidebar 80. As illustrated in FIG. 7, the rack pin body 62 generally has a thickness such that the rack pin body 62 contacts the sidebar rail portion 82 and prevents radial movement of the sidebar 80. When a proper key 150 is inserted in the keyway 39, the rack pin 60 is moved axially, as described below, such that the sidebar notch 64 is aligned with the sidebar rail portion 82 as shown in FIG. 10. With each rack pin 60 so aligned, the sidebar 80 is movable radially inward. In the present embodiment, the sidebar 80 does not automatically move radially inward, but instead is biased radially outward as explained above. Referring to FIG. 12, with the proper key 150 inserted, the rack pins 60 are disengaged from the through bores 29 and the sidebar notches 64 are properly aligned, such that rotation of the key 150 causes the tapered portion 84 of the sidebar 80 to ride up the tapered groove 25 as the sidebar rail portion 82 is received in the notches 64. The lock cylinder assembly 10 is in an unlocked condition such that the cylinder plug 40 is rotatable relative to the housing 20. Rotation of the cylinder plug 40 actuates the output mechanism. When the key 150 is rotated back to the home position, the sidebar 80 automatically extends radially into engagement with the tapered groove 25. When the key 150 is removed, the rack pins 60 return to the home position wherein the notch 64 is no longer aligned with the sidebar rail portion 82 and the sidebar 80 is prevented from moving radially inward.

To facilitate axial movement of the rack pins 60 in response to an inserted key, each rack pin 60 is associated with a tongue pin 90 which extends perpendicular to the rack pin 60 across the keyway 39. Each tongue pin 90 includes a tongue 92 that is selectively engagable with one of the engagement passages 66 of the rack pin 60 through an opening 65 in the back of the rack pin 60 (see FIGS. 8-10). In the present embodiment, the engagement passages 66 have a serrated configuration and the tongues 92 have a corresponding inverted triangular configuration, however, other complementary configurations may also be utilized.

Figure 6:
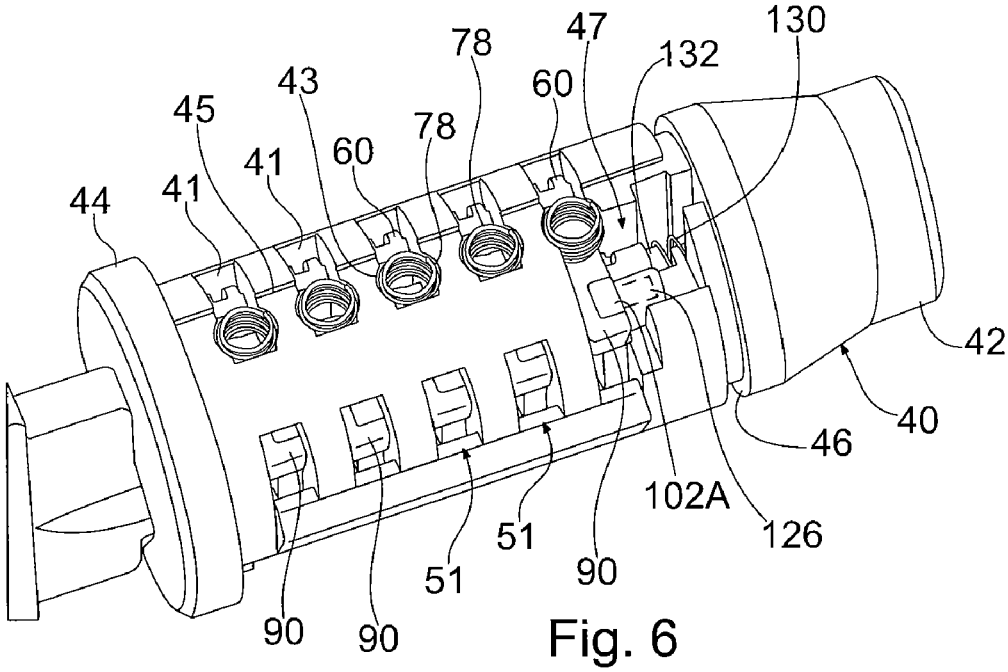
FIG. 6 is a top isometric view of the lock cylinder plug with the top cover removed.

In the present embodiment, a spring 78 or the like extends between a top cover 70 and the respective tongue pin 90 to bias the tongue pin 90 downward. When the tongue pin 90 is engaged with a corresponding rack pin 60, the spring 78 thereby biases the rack pin 60 toward the locked position wherein the rack pin end 68 extends into the housing though bore 29 and the notch 64 is not aligned with the sidebar rail portion 82. The present top cover 70 includes an inward spring mount 74 depending from its body 72 for each spring 78. As shown in FIG. 6, the cylinder body 42 desirably includes a spring bore 43 for each spring 78 and mount 74 and a channel 45 configured to receive the top cover body 72. The spring bores 43 may be formed integrally with the rack pin bores 41 as illustrated. The top cover 70 also includes a depending portion 76 configured to cover and retain a reset actuator 120 positioned within a cavity 47 of the cylinder body 42.

In the present embodiment, a re-combinating sidebar 100 is utilized to control the selective engagement between the tongue 92 and the engagement passage 66, as described in more detail below. Referring to FIGS. 1, 4, 6 and 7, the re-combinating sidebar 100 includes a plurality of shaft portions 102, each configured to be received in an alignment notch 94 of a corresponding tongue pin 90. A tapered bar 104 extends perpendicular from the shaft portions 102 and is connected thereto by bridging members 106. The cylinder body 42 includes a plurality of vertical slots 51, each configured to receive a corresponding shaft portion 102 with a tongue pin 90 engaged therewith. Each vertical slot 51 terminates in a horizontal slot 53 configured to receive a corresponding bridging member 106 and thereby guide radial movement of the re-combinating sidebar 100. A horizontal opening 50 extends through the side of the cylinder body 42 and is in communication with the vertical slots 51 such that the tapered bar 104 may extend radially outwardly from the cylinder plug 40. A plurality of springs 108 or the like are positioned between the cylinder body 42 and the tapered bar 104 such that the re-combinating sidebar 100 is biased radially outward.

Referring to FIG. 7, during normal operation, the re-combinating sidebar 100 is maintained in a radially inward position such that each tongue 92 of the tongue pins 90 remains engaged with the intended engagement passage 66 of the corresponding rack pin 60. With reference to FIGS. 1, 6, 17 and 18, a reset actuator 120 is engagable between the cylinder body 42 and the re-combinating sidebar 100 to maintain the re-combinating sidebar 100 in this radially inward, normal operation mode. The reset actuator 120 includes an actuator body 122 with a reset contact 124 depending therefrom. A front face of the actuator body 122 includes two bores 126 and 128. Each bore 126, 128 is configured to receive a post 103 extending rearward from rearward most shaft portion 102A (see FIG. 17). In the normal operating mode, the post 103 is received in inward bore 126, as shown in phantom in FIG. 6, and thereby maintains the re-combinating sidebar 100 in the radially inward, normal operating position. A spring 130 or the like engages a mount 132 on the rear side of the actuator body 122 and biases the reset actuator 120 toward the re-combinating sidebar 100, thereby maintaining the post 103 engaged within the bore 126 unless an proper reset key 150' is positioned in the keyway 39.

Figure 14:
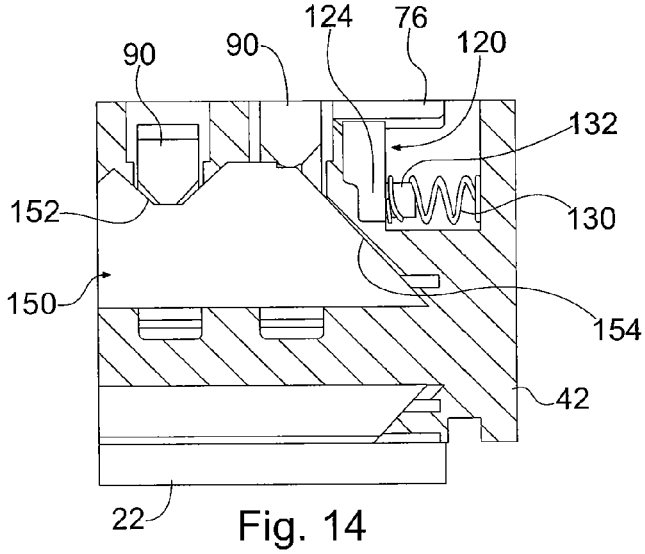
FIG. 14 is a cross-sectional view illustrating the relative position of a user key to the reset actuator during normal operation.
Figure 15:
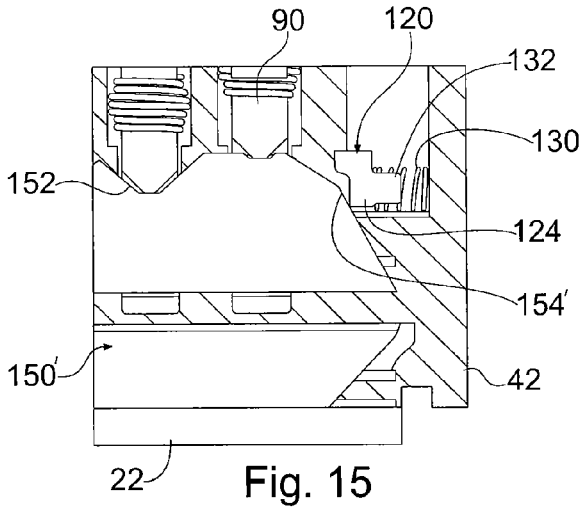
FIG. 15 is a cross-sectional view similar to FIG. 14 illustrating the engagement of a reset key with the reset actuator.
Figure 16:
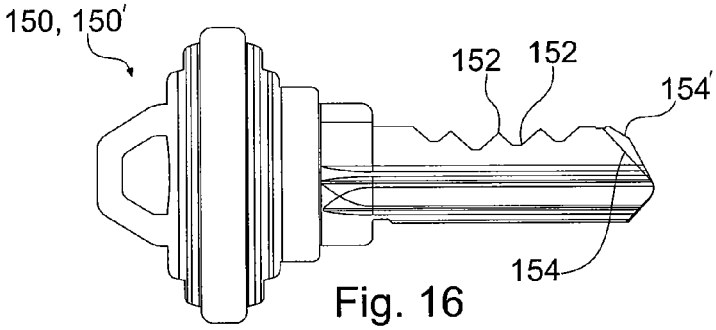
FIG. 16 is a side elevational view of a key illustrating both a user key configuration and a reset key configuration.

Referring to FIGS. 14-16, the present embodiment of the invention utilizes two distinct types of keys, namely a user key 150 and a reset key 150'. Both keys 150, 150' include a plurality of teeth and notches 152, but the reset key 150' includes a protruding tip 154' compared to the tapered tip 154 of the user key 150. As shown in FIG. 14, during normal operation, a user inserts a user key 150 and the tapered tip 154 remains clear of the actuator reset contact 124. The actuator 120 remains biased by the spring 130 toward the re-combinating sidebar 100, thereby maintaining the post 103 engaged within the bore 126. As such, the re-combinating sidebar 100 is maintained in the inward position and each tongue 92 remains engaged with the previously programmed engagement passage 66. A user can insert a proper user key 150 which will engage the tongue pins 90 which in turn will move the rack pins 60 axially such that the rack pin notches 64 are aligned with the sidebar rail portion 82. The lock cylinder assembly 10 may be utilized in a normal manner as described above.

Figure 17:
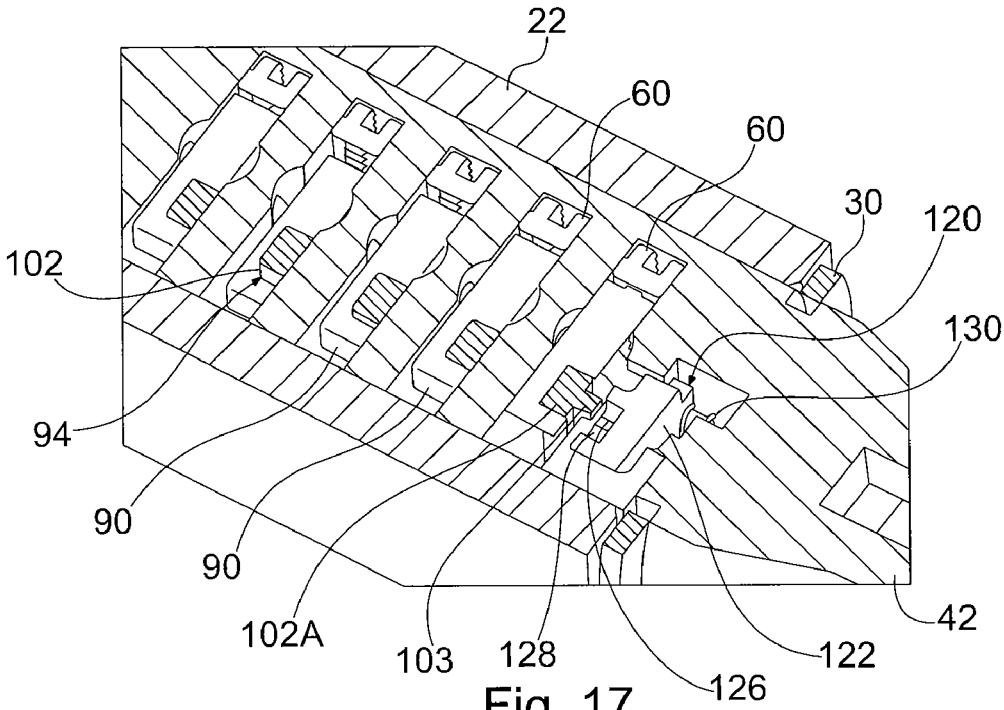
FIG. 17 is a top down cross-sectional view of the lock cylinder assembly with a reset key positioned in the keyway and the reset actuator moved to a reset position.
Figure 18:
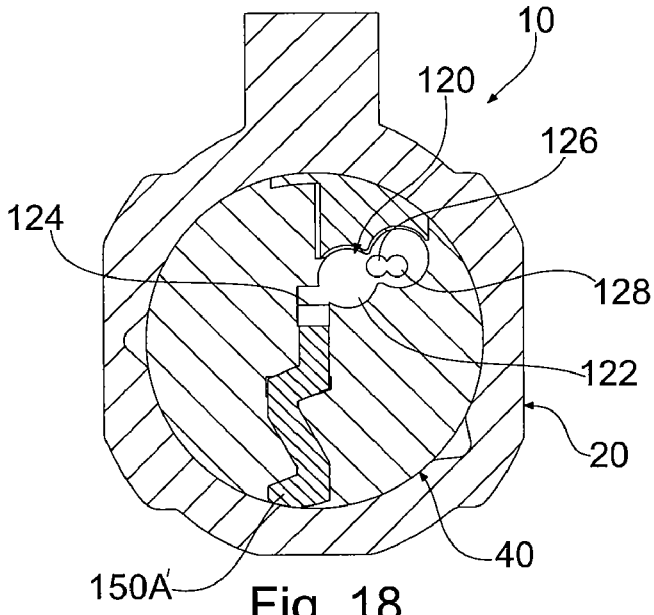
FIG. 18 is a cross-sectional view illustrating a reset key engaging the reset actuator.
Figure 19:
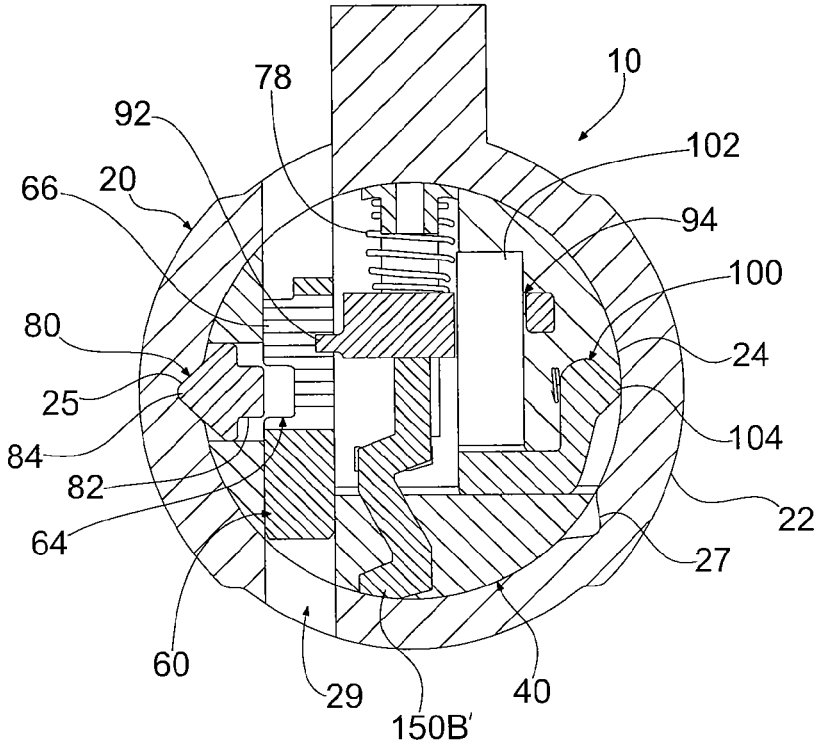
FIG. 19 is a cross-sectional view similar to FIG. 7 with a current reset key inserted into the lock cylinder assembly.

If a user desires to reprogram the lock cylinder assembly 10 without disassembling the lock cylinder assembly, the user may insert a proper reset key 150'. Insertion of the reset key 150' will cause the protruding tip 154' to engage the actuator reset contact 124 and thereby disengage the post 103 from the bore 126 as illustrated in FIGS. 15 and 17. As explained below, reprogramming of the lock cylinder assembly 10 requires rotation of the cylinder plug 40. As such, inserting an improper key, even if such engages the actuator reset contact 124, will not allow reprogramming because the improper key will not properly move the rack pins 60 and the cylinder plug 40 will not be rotatable.

Having generally described the components of the lock cylinder assembly 10, reprogramming thereof will now be described with reference to FIGS. 15-28. To reprogram the lock cylinder assembly 10, the user inserts a current reset key 150A' into the keyway as illustrated in FIGS. 15-19. By "current", it is meant that the reset key 150A' has a tooth and notch 152 configuration which matches the currently programmed configuration of the lock cylinder assembly 10. When the current reset key 150A' is inserted, the key 150A' engages each of the tongue pins 90 and moves the respective rack pins 60 to the unlock position shown in FIG. 19 wherein each notch 64 is aligned with the sidebar rail portion 82. The protruding tip 154' of current reset key 150A' also engages the actuator reset contact 124 and thereby disengages the reset actuator 120 from the post 103. Even though the reset actuator 120 is disengaged, the re-combinating sidebar 100 remains inward, and thereby maintains each tongue 92 engaged with the respective engagement passage 66, because the tapered bar 104 is in contact with the inside surface of the housing opening 24.

Figure 20:
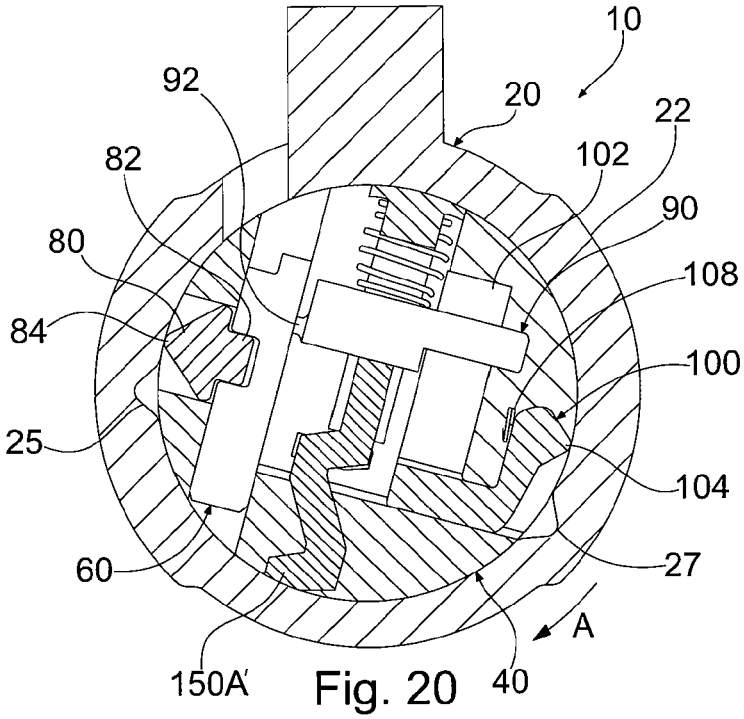
FIG. 20 is a cross-sectional view similar to FIG. 19 with the current reset key inserted into the lock cylinder assembly and the cylinder plug initially rotated.
Figure 21:
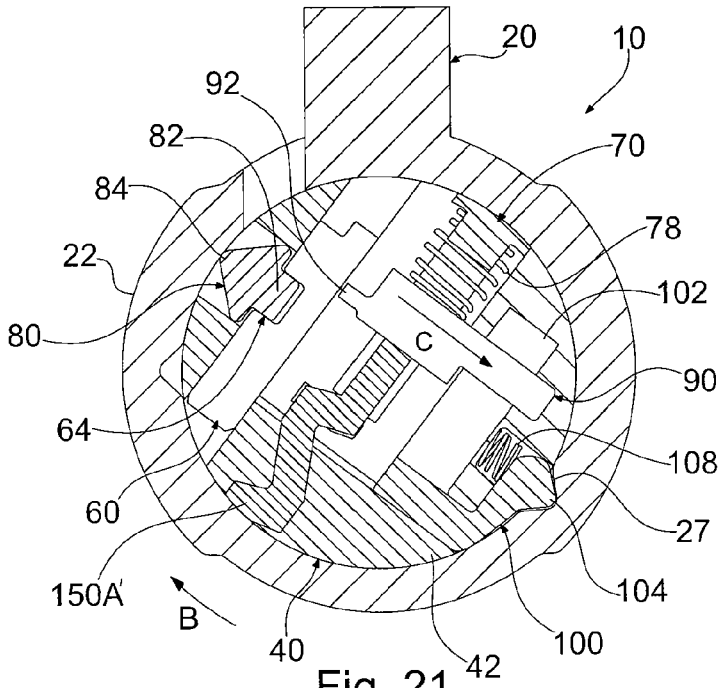
FIG. 21 is a cross-sectional view similar to FIG. 19 with the reset key inserted into the lock cylinder assembly and the cylinder plug rotated to a reset position.
Figure 22:
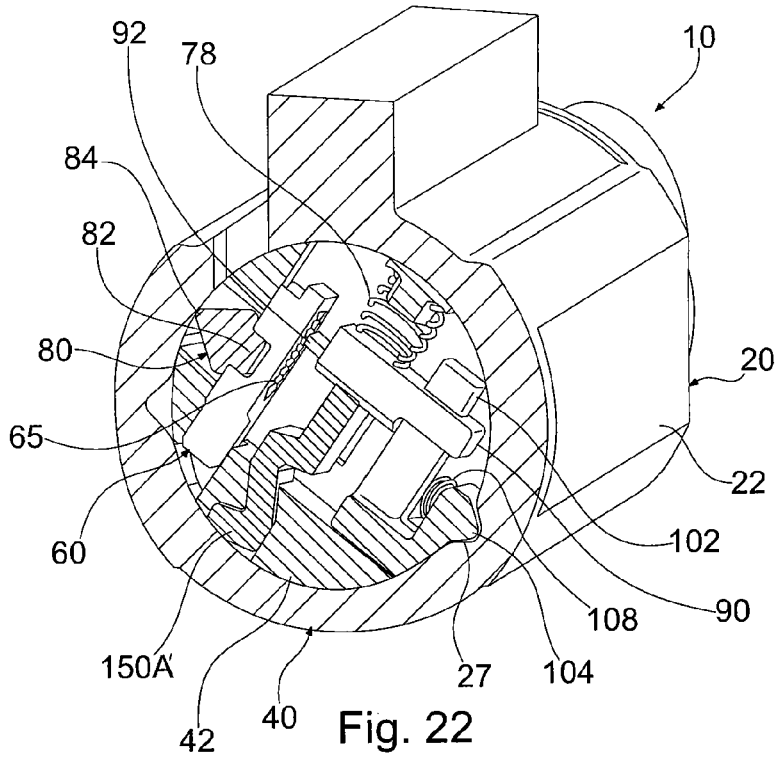
FIG. 22 is an isometric view of the lock cylinder assembly as shown in FIG. 21.

The current reset key 150A' is then rotated in the direction of arrow A in FIG. 20. While clockwise rotation is illustrated in the present embodiment, the invention is not limited to such. For example, the tapered groove 27 may be positioned in the upper right quadrant of the housing body 22, in which case the plug cylinder 40 would be rotated counter-clockwise for reprogramming, or in any other desired position. As with normal operation, the sidebar tapered portion 84 rides up the tapered groove 25 as the sidebar rail portion 82 is received in the notches 64. Rotation of the key and cylinder plug 40 in the direction of arrow B in FIG. 21 is continued until the tapered bar 104 is aligned with the tapered groove 27 in the housing 20. The springs 108 bias the re-combinating sidebar 100 radially outward as the tapered bar 84 enters the tapered groove 27. As the re-combinating sidebar 100 moves radially outward, each tongue pin 90 is also moved in the direction of arrow C in FIG. 21 such that the tongues 92 disengage from the respective engagement passages 66. The rack pins 60 stay aligned with the sidebar 80 based on the engagement of the rail portion 82 in each of the notches 64.

Figure 23:
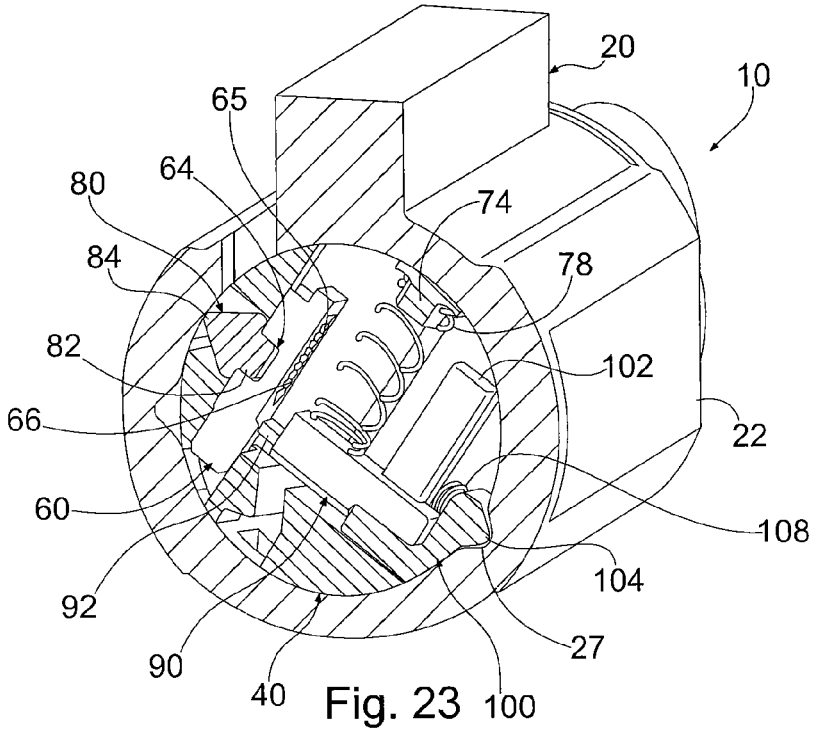
FIG. 23 is a cross-sectional view similar to FIG. 21 with the reset key removed.
Figure 24:
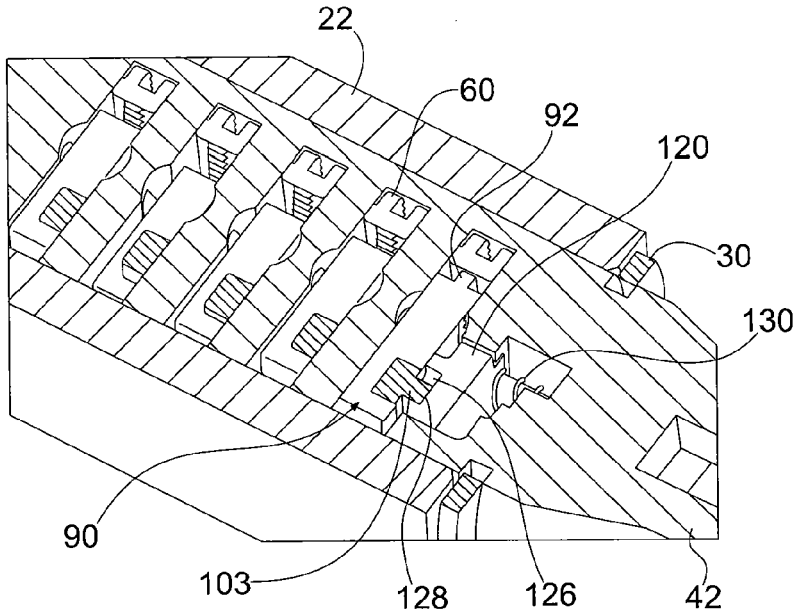
FIG. 24 is a top down cross-sectional view similar to FIG. 17 with the reset key removed and the reset actuator moved to a reset locked position.

Referring to FIGS. 23 and 24, the current reset key 150A' is removed whereby the top springs 78 bias the tongue pins 90 to a lower most position wherein the tongues 92 are not aligned with any of the engagement passages 66. Additionally, when the current reset key 150A' is removed, the actuator reset contact 124 is no longer engaged and the spring 130 biases the reset actuator 120 toward the re-combinating sidebar 100. With the re-combinating sidebar 100 in the outward reprogram position, the post 103 engages in the outer bore 128, thereby locking the re-combinating sidebar 100 in such outward reprogram position. This prevents a user from insert a regular user key (non-reset key) and trying to return the cylinder plug 40 to the home position. Additionally, because the tongues 92 do not align with any engagement passages, a user would not be able to insert an object into the keyway to try to bypass the reset actuator 120 as the tongues 92 would contact the body 62 of the rack pins 60 and prevent the re-combinating sidebar 100 from moving inward.

Figure 25:
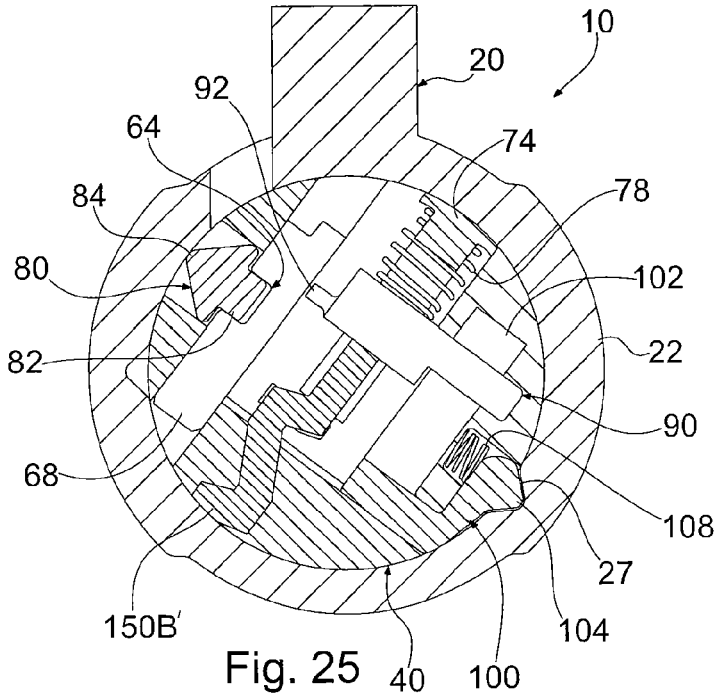
FIG. 25 is a cross-sectional view similar to FIG. 21 with a new reset key inserted into the lock cylinder assembly.
Figure 26:
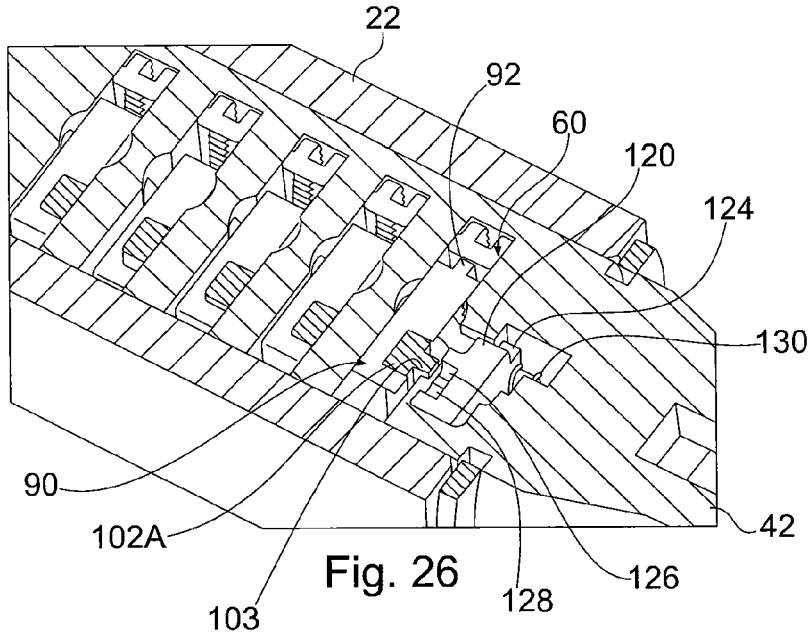
FIG. 26 is a top down cross-sectional view similar to FIG. 17 with the new reset key inserted and the reset actuator moved to the reset position.

To complete the reprogramming, it is necessary for the user to insert a new reset key 150B' as illustrated in FIGS. 25 and 26. By "new", it is meant that the reset key 150B' has a tooth and notch 152 configuration which matches the configuration of the intended or new user key to which the lock cylinder assembly 10 is to be programmed. When the new reset key 150B' is inserted, each of the tongue pins 90 is moved to a desired position relative to a respective rack pin 60. Additionally, the protruding tip 154' of the new reset key 150B' engages the actuator reset contact 124 and disengages the reset actuator 120.

Figure 27:
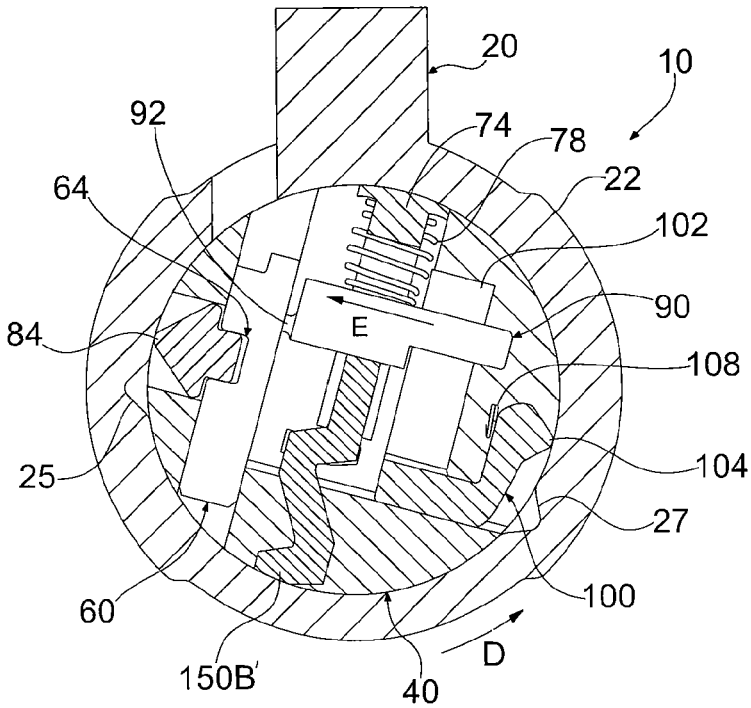
FIG. 27 is a cross-sectional view similar to FIG. 25 illustrating rotation of cylinder plug with the new reset key inserted therein from the reset position to the home position.

The new reset key 150B' is rotated in the reverse direction, as indicated by arrow D in FIG. 27, which causes the tapered bar 104 to ride up the tapered groove 27 and move the re-combinating sidebar 100 radially inward. As the re-combinating sidebar 100 moves radially inward, the tongue pins 90 move in the direction indicated by arrow E, thereby engaging each tongue 92 with a corresponding engagement passage 66 based on new reset key 150B' tooth and notch 152 configuration.

Figure 28:
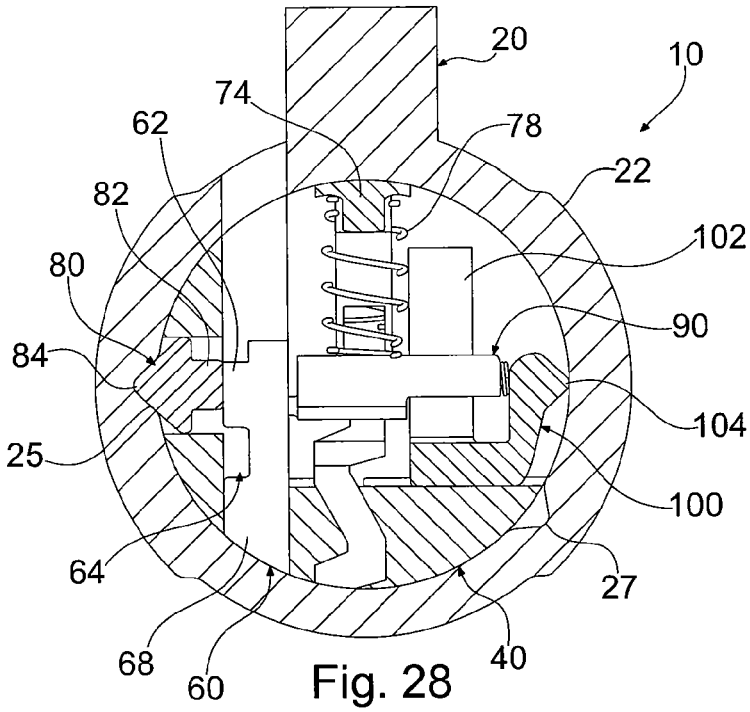
FIG. 28 is a cross-sectional view similar to FIG. 27 illustrating the reprogrammed cylinder plug in the home position with the new reset key removed.

Once the cylinder plug 40 is returned to the home position as illustrated in FIG. 28, the key 150B' is removed. Upon removal, the reset actuator 120 is biased toward the re-combinating sidebar 100 such that post 103 is received in bore 126, thereby locking the re-combinating sidebar 100 and the associated tongue pins 90 in position. The reprogrammed lock cylinder assembly 10 may thereafter be operated in a normal manner with user keys 150 having the new configuration.

A programmable lock cylinder assembly 210 in accordance with a second embodiment of the invention is illustrated and described with reference to FIGS. 29-55. Referring to FIGS. 29-38, the programmable lock assembly 210 generally comprises a lock housing 220 and a cylinder plug 240. The lock housing 220 includes a body 222 defining a generally tubular opening 224 extending the length thereof. The tubular opening 224 is configured to receive the cylindrical body 242 of the cylinder plug. Referring to FIG. 30, the cylinder plug 240 preferably extends out the opposite end of the housing 220 and is configured for connection to an output mechanism (not shown) for transmitting force from the cylinder plug 240 to one or more elements connected to the lock cylinder assembly 210. The output mechanism can take a number of different forms, including without limitation, a lever, drive shaft, coupling, cam, or other element mounted to the lock cylinder assembly 210. The present lock cylinder assembly may be utilized in any desired application. In the illustrated embodiment, a snap ring 230 engages a groove 246 in the cylinder body 242 to retain the lock cylinder assembly 210 in the assembled state illustrated in FIG. 30.

Figure 29:
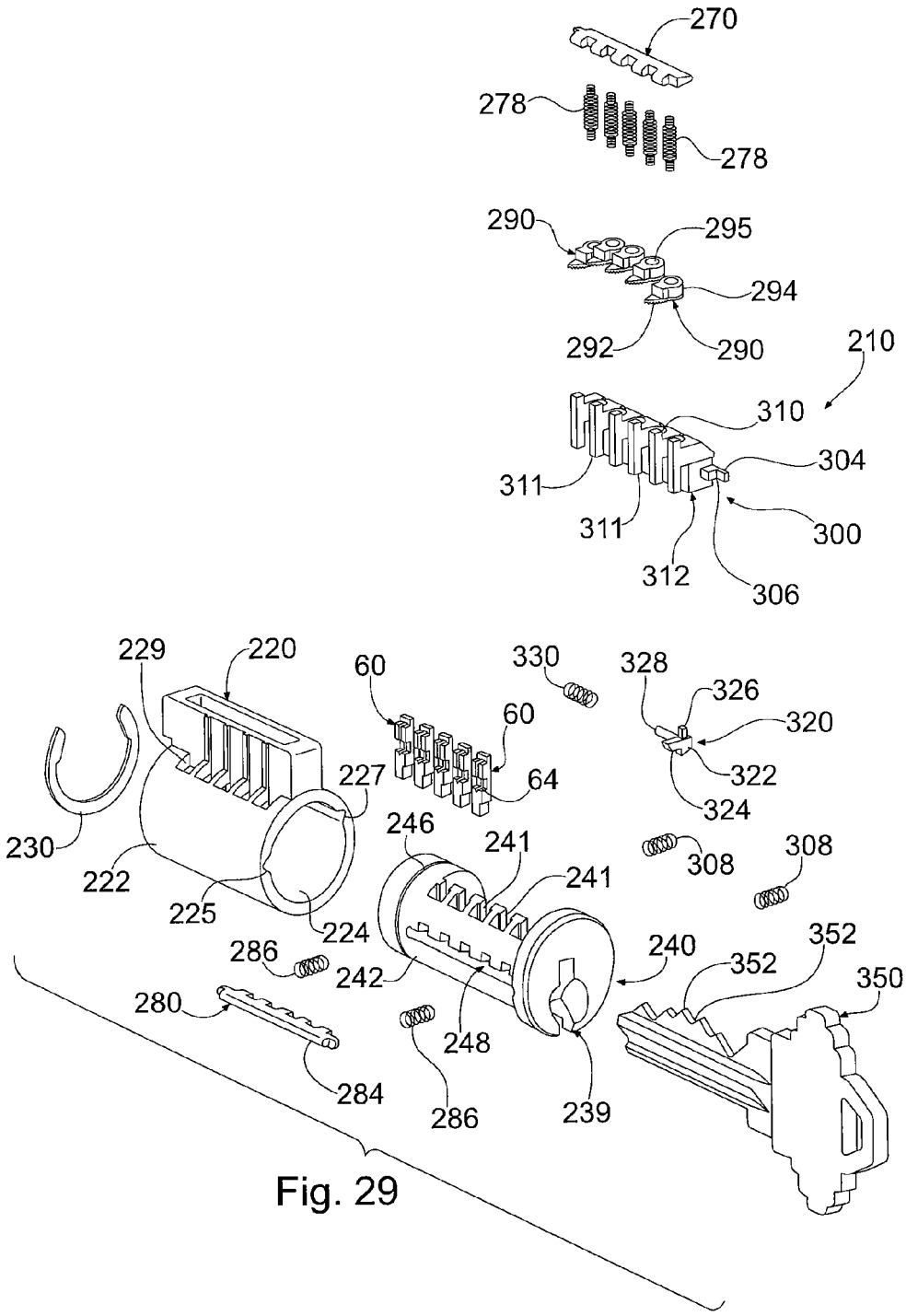
FIG. 29 is an exploded isometric view of a programmable lock cylinder assembly according to another embodiment of the invention.
Figure 30:
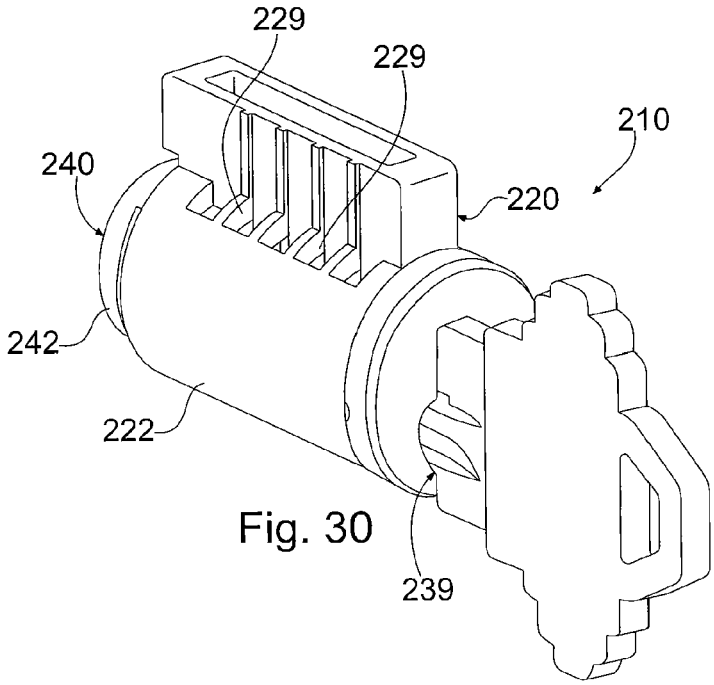
FIG. 30 is an assembled isometric view of the programmable lock cylinder assembly of FIG. 29 with a key inserted therein.
Figure 31:
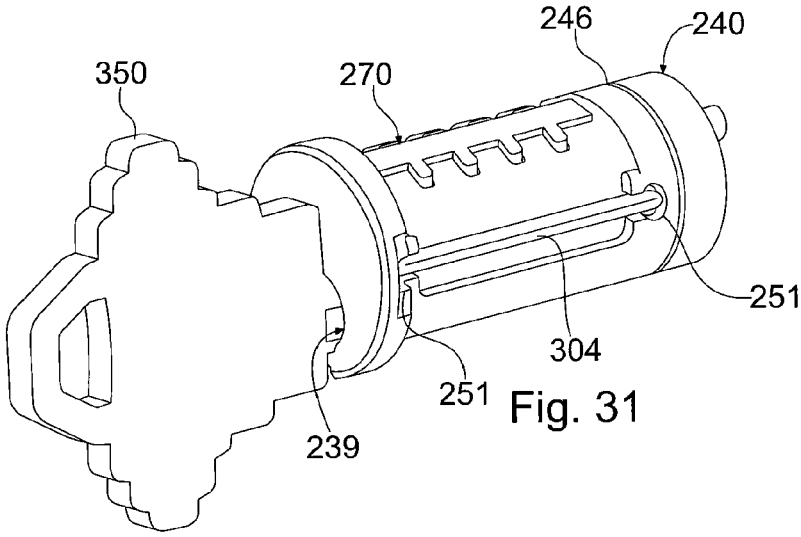
FIG. 31 is an isometric view similar to FIG. 30 with the lock housing removed.
Figure 37:
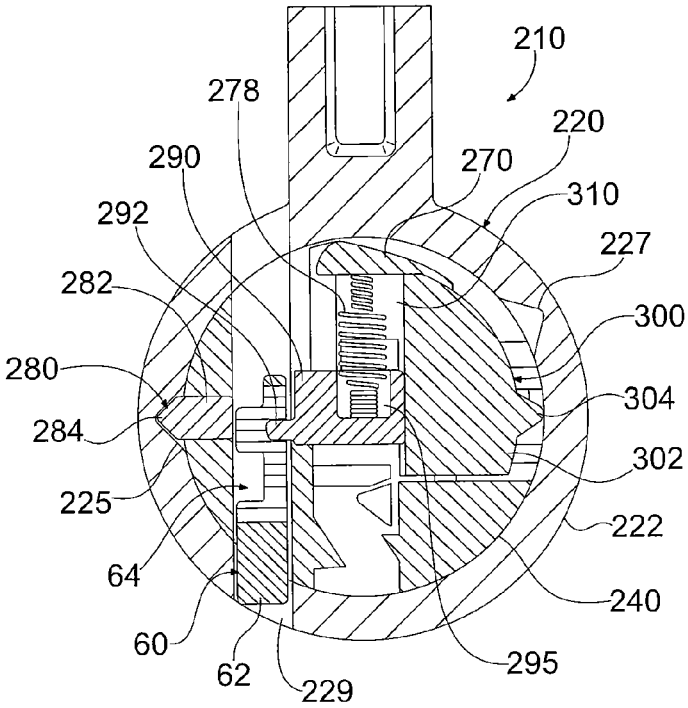
FIG. 37 is a cross-sectional view of the lock cylinder assembly of FIG. 29 in a home position.

Referring to FIGS. 29 and 37, the housing body 222 includes a pair of tapered grooves 225 and 227 extending along the inside surface of the opening 224. As in the previous embodiment, a sidebar 280 extends from the cylinder plug 240 and engages the tapered groove 225 to maintain the cylinder plug 240 rotationally locked relative to the housing 220 unless a proper key is positioned in the keyway 239 of the cylinder plug 240. The tapered groove 227 facilitates reprogramming of the lock cylinder assembly 210, as described in more detail hereinafter.

Figure 38:
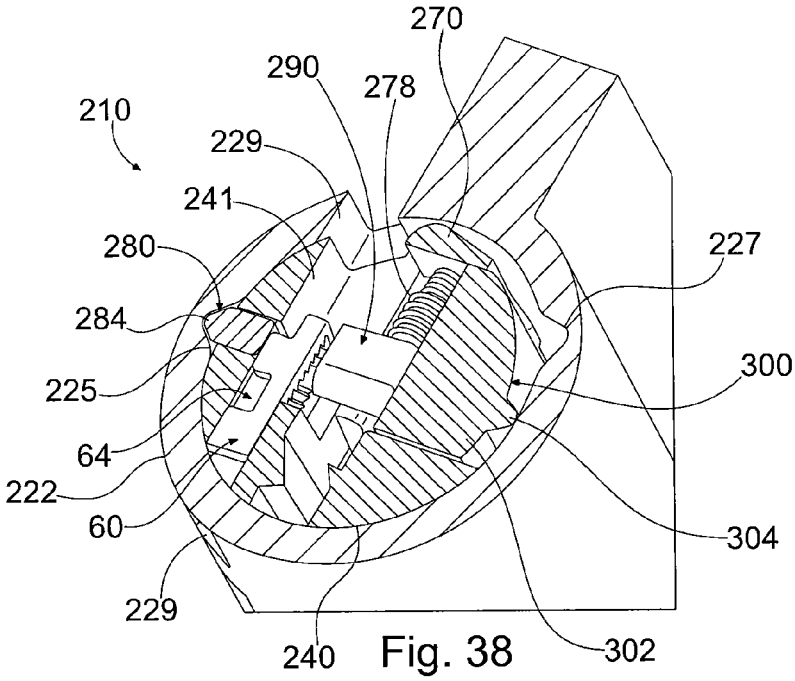
FIG. 38 is an isometric view of the lock cylinder assembly as shown in FIG. 37.

Referring to FIGS. 29 and 38, the housing body 222 may include a plurality of through bores 229 which align with rack pin bores 241 of the cylinder plug 240 when the cylinder plug 240 is positioned in a home position. The through bores 229 are configured to receive a portion of an associated rack pin 60, as described hereinafter, to further maintain the cylinder plug 240 rotationally locked relative to the housing 220 unless a proper key is positioned in the keyway 239 of the cylinder plug 240. Desirably, through bores 229 are provided on the upper and lower surfaces, in the illustrated orientation, such that the lock cylinder assembly 210 may be provided with upper and lower rack pins, if desired, for operation with a key having teeth on its upper and lower surfaces.

Referring to FIGS. 29, 32, 34 and 38, the rack pin bores 241 extend substantially parallel to the keyway 239 of the cylinder plug 240. Each rack pin bore 241 is configured to receive and guide the axial movement of a rack pin 60. The rack pins 60 are substantially the same as the rack pins 60 of the previous embodiment as shown in FIG. 9. Each rack pin bore 241 desirably extends completely through the cylinder plug 240 such that the associated rack pin 60 may be configured to be moved upward or downward into engagement with an associated through bore 229, however, such is not required. Alternatively, the rack pin bores 241 may only extend from one is surface of the cylinder plug body 242, or may even be completely internal within the cylinder plug body 242 such that the rack pins do not extend from the cylinder plug 240.

Referring to FIGS. 29, 32, 34 and 35, a sidebar opening 248 extends through a side surface of the cylinder body 242 in communication with the rack pin bores 241. The sidebar opening 248 is sized to receive a sidebar 280 such that a tapered portion 284 of the sidebar 280 is radially extendable from the cylinder plug 240. In the home position illustrated in FIG. 37, the tapered portion 284 extends from the cylinder plug 240 and is engaged in the tapered groove 225 to rotationally lock the cylinder plug 240 relative to the housing 220. One or more springs 286 are positioned between a rail portion 282 of the sidebar 280 and internal portions 249 of the cylinder body 242 to bias the sidebar radially outward.

Figure 39:
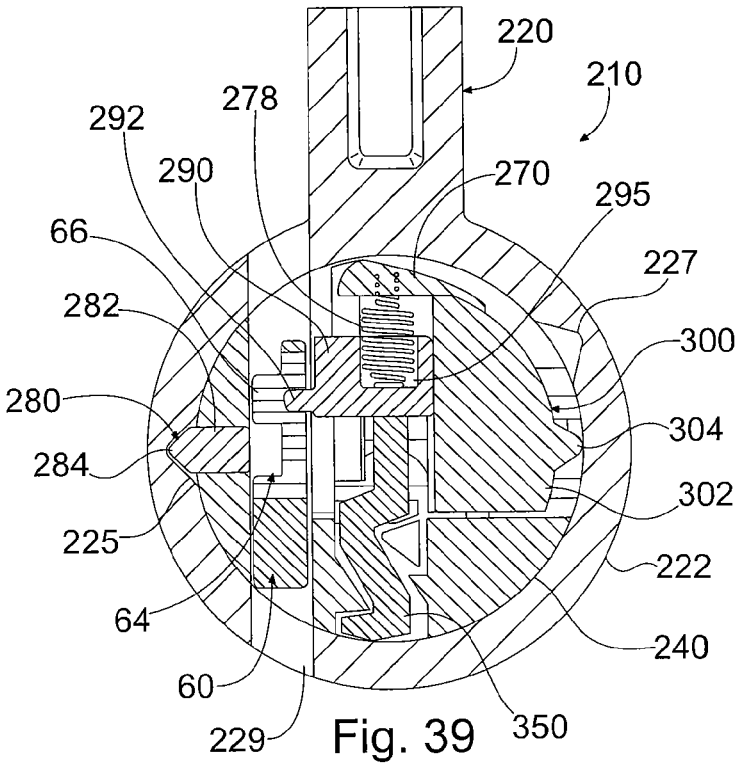
FIG. 39 is a cross-sectional view similar to FIG. 37 with a key inserted into the lock cylinder assembly.
Figure 41:
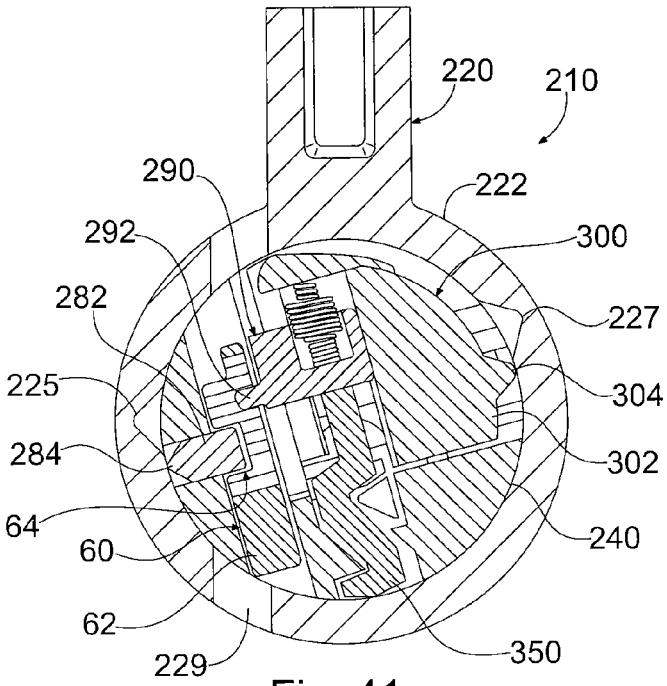
FIG. 41 is a cross-sectional view similar to FIG. 37 with a key inserted into the lock cylinder assembly and the cylinder plug rotated to an unlock position.

The sidebar 280 is prevented from being moved radially inward, and thereby unlocking the lock, by the rack pins 60 unless a proper key is positioned in the keyway 239. The rack pins 60 of the present embodiment have the same configuration as the exemplary rack pin 60 illustrated in FIG. 9, but may have other configurations. As explained above, each rack pin 60 also includes a sidebar notch 64 configured to receive the rail portion 282 of the sidebar 280. As illustrated in FIG. 37, the rack pin body 62 generally has a thickness such that the rack pin body 62 contacts the sidebar rail portion 282 and prevents radial movement of the sidebar 280. When a proper key 350 is inserted in the keyway 239, the rack pin 60 is moved axially, as described below, such that the sidebar notch 64 is aligned with the sidebar rail portion 282 as shown in FIG. 39. With each rack pin 60 so aligned, the sidebar 280 is movable radially inward. In the present embodiment, the sidebar 280 does not automatically move radially inward, but instead is biased radially outward as explained above. Referring to FIG. 41, with the proper key 350 inserted, the rack pins 60 are disengaged from the through bores 229 and the sidebar notches 64 are properly aligned, such that rotation of the key 350 causes the tapered portion 284 of the sidebar 280 to ride up the tapered groove 225 as the sidebar rail portion 282 is received in the notches 64. The lock cylinder assembly 210 is in an unlocked condition such that the cylinder plug 240 is rotatable relative to the housing 220. Rotation of the cylinder plug 240 actuates the output mechanism. When the key 350 is rotated back to the home position, the sidebar 280 automatically extends radially into engagement with the tapered groove 225. When the key 350 is removed, the rack pins 60 return to the home position wherein the notch 64 is no longer aligned with the sidebar rail portion 282 and the sidebar 280 is prevented from moving radially inward.

To facilitate axial movement of the rack pins 60 in response to an inserted key, each rack pin 60 is associated with a tongue pin 290 which extends perpendicular to the rack pin 60 across the keyway 239. Each tongue pin 290 includes a tongue 292 that is selectively engagable with one of the engagement passages 66 of the rack pin 60 through an opening 65 in the back of the rack pin 60 (see FIG. 36). In the present embodiment, the engagement passages 66 have a serrated configuration and the tongues 292 have a corresponding inverted triangular configuration, however, other complementary configurations may also be utilized.

In the present embodiment, each tongue pin 290 has a circular body portion 294 opposite the tongue 292. The circular body portion 294 is configured to be received in a corresponding circular bore 310 of the re-combinating sidebar 300 as described hereinafter. The corresponding circular configurations guide the tongue pins 290 as they move up and down in the bores 310. Other corresponding shapes other than circular may also be utilized.

Figure 32:
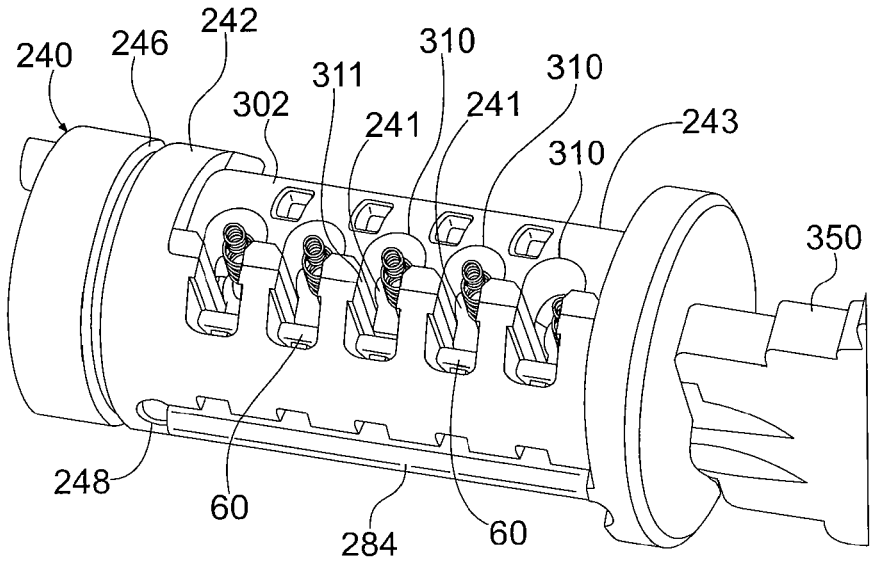
FIG. 32 is a left, top isometric view of the lock cylinder plug with the housing removed.
Figure 33:
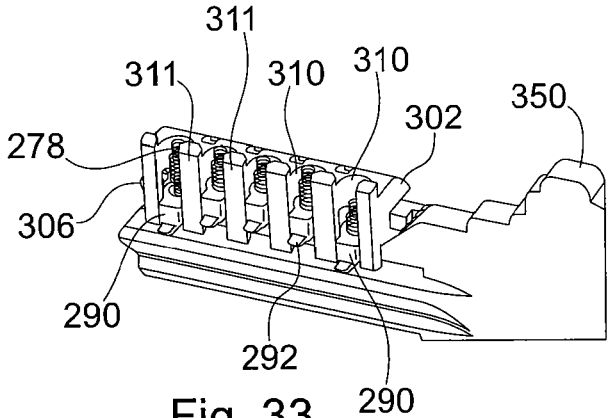
FIG. 33 is an isometric view of a key with a re-combinating sidebar and tongue pins of the present embodiment positioned relative thereto.
Figure 34:
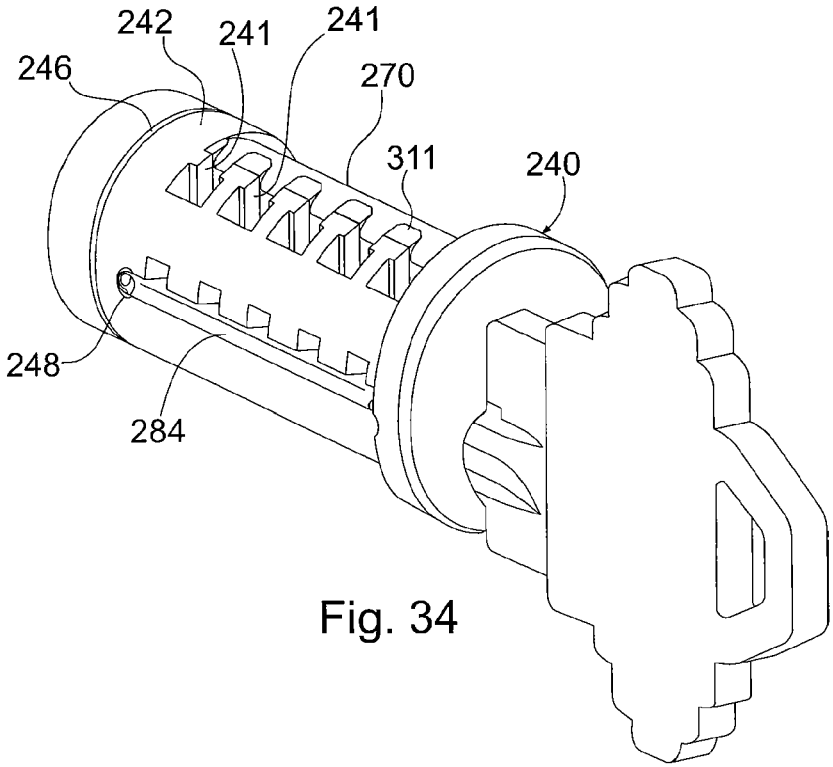
FIG. 34 is a left-side isometric view of the lock cylinder.
Figure 35:
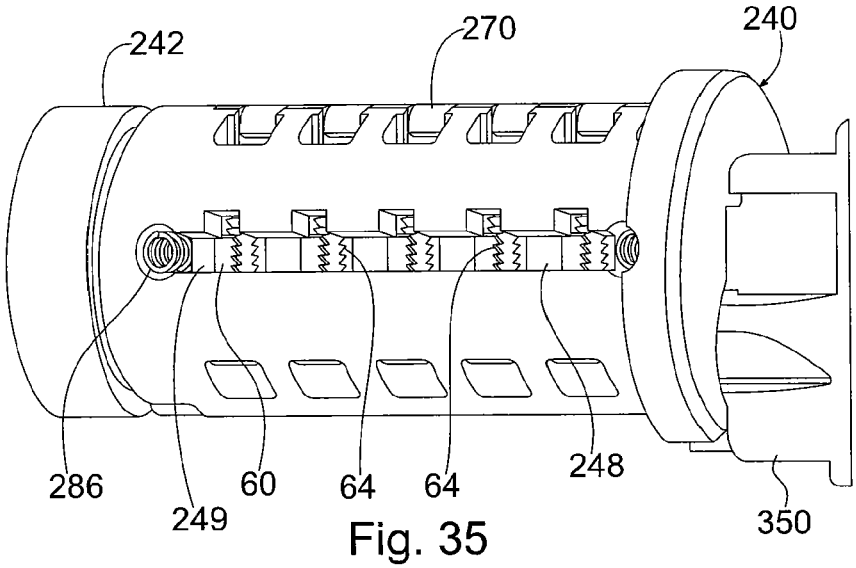
FIG. 35 is a left-side isometric view of the lock cylinder plug with the locking sidebar removed.
Figure 36:
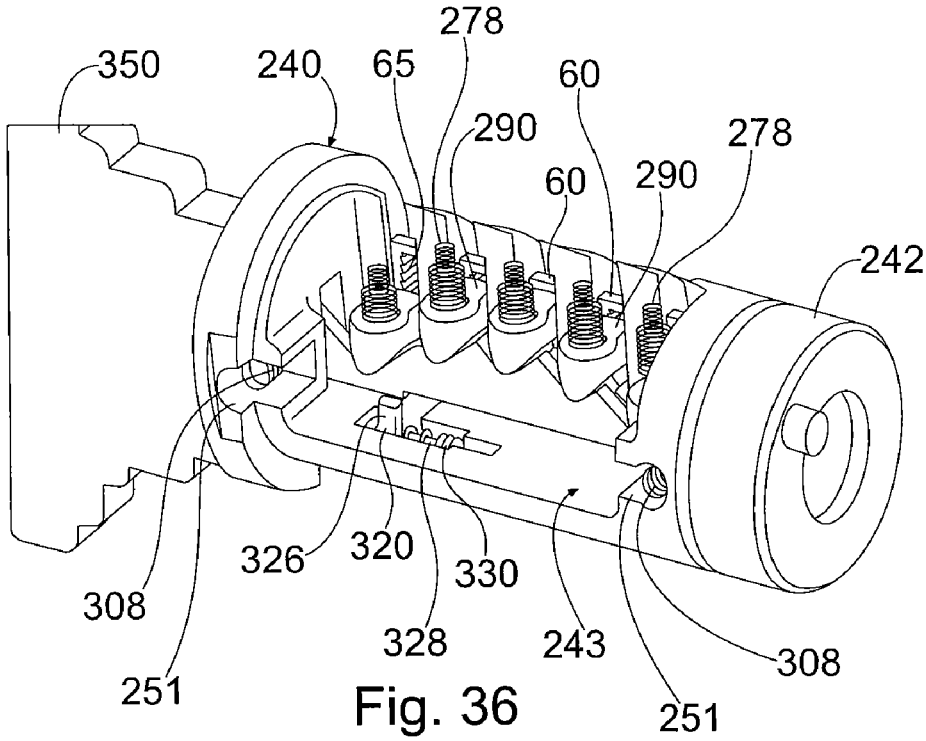
FIG. 36 is a right-side isometric view of the lock cylinder plug with the re-combinating sidebar removed.

Referring to FIGS. 36 and 37, a detent 295 is provided in each circular body portion 294 and is configured to receive a spring 278 or the like extends between a top cover 270 and the respective tongue pin 290 to bias the tongue pin 290 downward. When the tongue pin 290 is engaged with a corresponding rack pin 60, the spring 278 thereby biases the rack pin 60 toward the locked position wherein the rack pin end 68 extends into the housing though bore 229 and the notch 64 is not aligned with the sidebar rail portion 282. As shown in FIG. 32, the cylinder body 242 desirably includes an open area 243 configured to receive the body of the re-combinating sidebar 300 which includes the bores 310.

In the present embodiment, the re-combinating sidebar 300 is utilized to control the selective engagement between the tongue 292 and the engagement passage 66, as described in more detail below. Referring to FIGS. 29, 32, 33 and 37, the re-combinating sidebar 300 includes a body portion 302 which defines the bores 310. A key contact surface 311 is provided between each adjacent pair of the bores 310, the key contact surfaces 311 spaced from the body portion 302 such that a sidebar keyway 312 is defined between the contact surfaces 311 and the body portion 302, as shown in FIG. 29. The tongue pins 290 extend across the sidebar keyway 312 such that they are engaged when a key 350 is inserted therein. A tapered bar 304 extends perpendicular from the body portion 302 opposite the bores 310. Guide members 306 extend from each end of the body portion 302 and are configured to be received in guide slots 251 in the cylinder body 242 (see FIG. 36). Positioning of the guide members 306 in the respective guide slots 251 guides radial movement of the re-combinating sidebar 300. The tapered bar 304 extends radially outwardly from the open area 243 of the cylinder plug 240. A spring 308 or the like is positioned within each guide slot between the cylinder body 242 and the tapered bar 304 such that the re-combinating sidebar 300 is biased radially outward.

Figure 42:
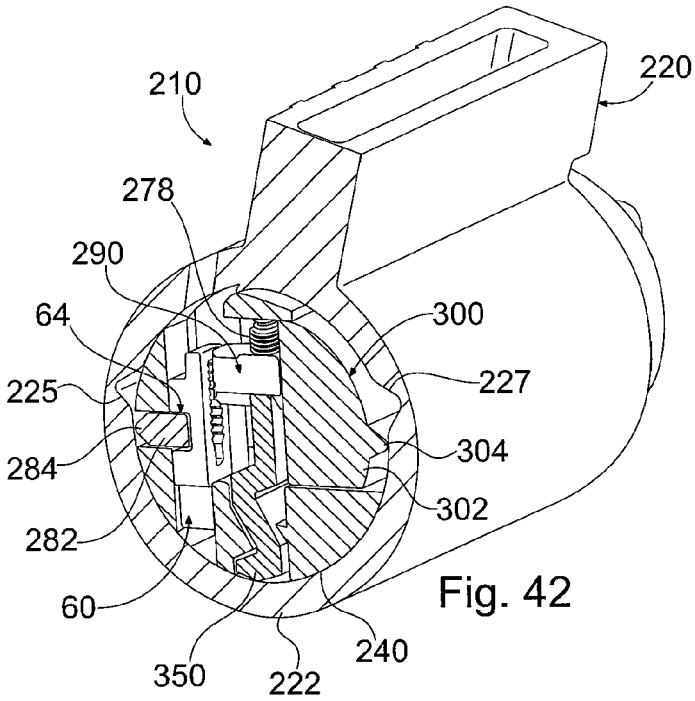
FIG. 42 is an isometric view of the lock cylinder assembly as shown in FIG. 41.

Referring to FIG. 37, during normal operation, the re-combinating sidebar 300 is maintained in a radially inward position by engagement of the tapered bar 304 with the inside surface 224 of the housing 220. In the radially inward position, each tongue 292 of the tongue pins 290 remains engaged with the intended engagement passage 66 of the corresponding rack pin 60. With reference to FIGS. 41 and 42, even if a user key 350 is inserted into the keyway 239 and the cylinder plug 230 is rotated, for example, to a position where the tapered bar 304 is circumferentially aligned with the tapered groove 227, contact of the key contact surfaces 311 of the sidebar 300 against the shank of the user key 350 prevents the sidebar 300 from moving radially outward, thereby maintaining the sidebar 300 in the normal operation mode. As will be described in more detail hereinafter, the reset key 350' has a thinned shank portion, such that a clearance is defined between the key shank 351' and the key contact surfaces 311 and the sidebar 300 is free to be urged radially outward, thereby disengaging the tongue pins 290 from the rack pins 60.

Figure 50:
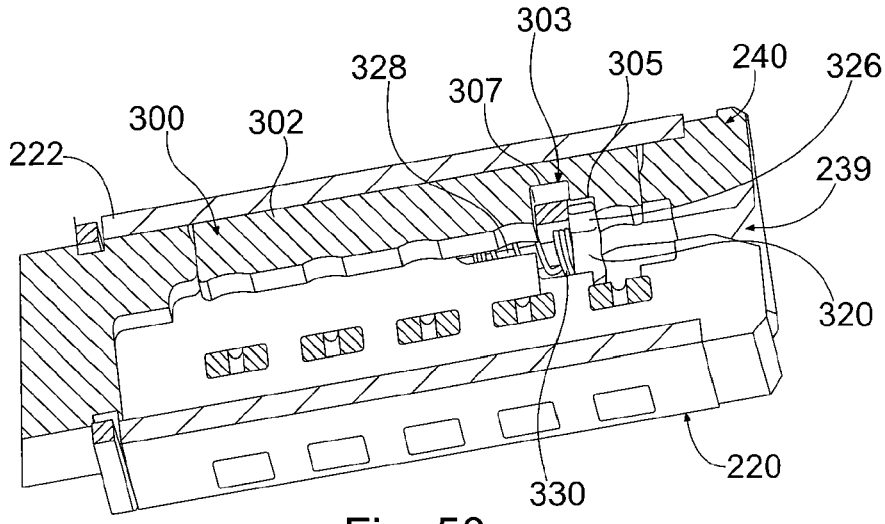
FIG. 50 is a top down cross-sectional view of the lock cylinder assembly with a reset key positioned in the keyway and the reset actuator moved to a reset position.
Figure 53:
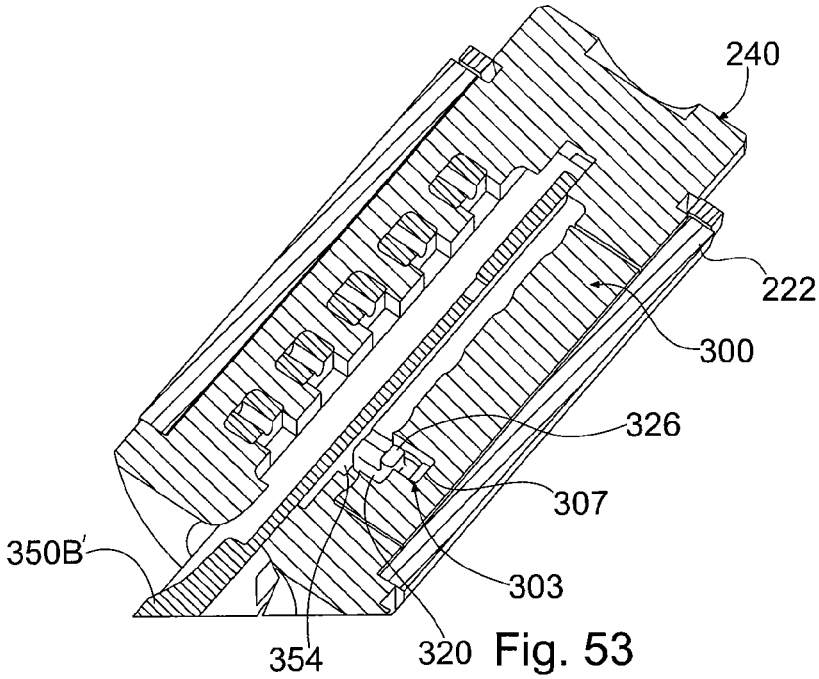
FIG. 53 is a top down cross-sectional view similar to FIG. 51 with the new reset key inserted and the reset actuator moved from the locked reset position.

Referring to FIGS. 29, 36, 50 and 51, a reset actuator 320 is positioned between the cylinder plug 240 and the sidebar 300 and is configured to maintain the sidebar 300 in a radially outward position during resetting. The reset actuator 320 includes an actuator body 322 with a reset contact 324 extending therefrom. An upper surface of the actuator body 322 includes a block 326 configured to engage a portion of the sidebar 300. A post 328 extends from the actuator body 322 and is configured to receive a spring 330 or the like such that the reset actuator 320 is spring biased within a groove in the plug cylinder 240, as shown in FIG. 36. As shown in FIGS. 50 and 53, the sidebar body portion 302 includes a notch 303 which defines a radially inner shoulder 305 and a radially outer shoulder 307. The block 326 engages the inner shoulder 305 when the sidebar 300 is locked in the resetting position as will be described. The spring 330 or the like biases the actuator 320 to this position once the cylinder plug 240 has been rotated to the reset position by an appropriate reset key and the sidebar 300 has been moved radially outward. The reset actuator 320 is biased toward engagement with the inner shoulder 305 until a proper reset key 350' is positioned in the keyway 239.

Figure 45:
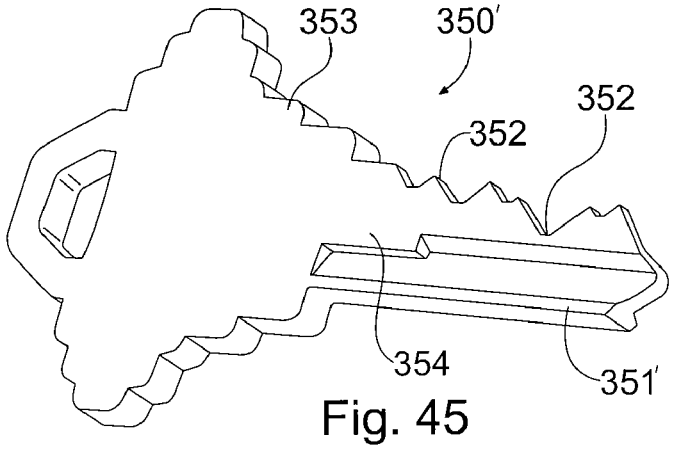
FIG. 45 is an isometric view of a reset key.
Figure 46:
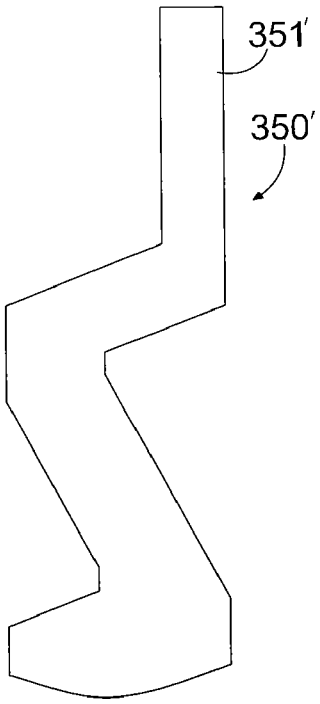
FIG. 46 is an end elevation view of the reset key of FIG. 45.
Figure 47:
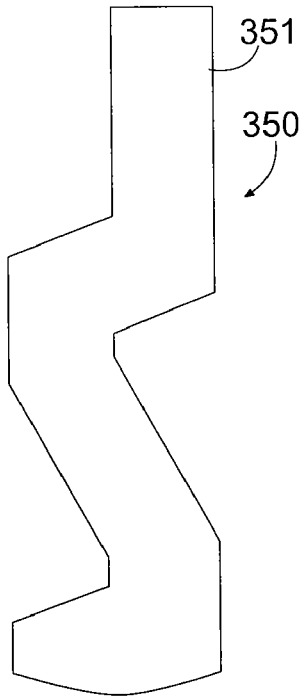
FIG. 47 is an end elevation view similar to FIG. 46 and illustrating the configuration of a user key.
Figure 48:
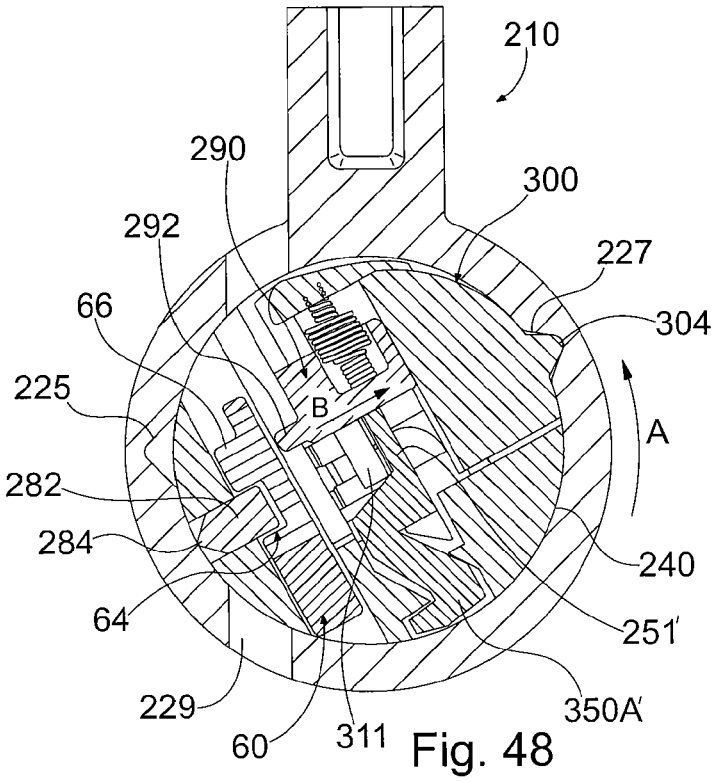
FIG. 48 is a cross-sectional view similar to FIG. 44 with the current reset key inserted into the lock cylinder assembly and the cylinder plug rotated to a reset position.
Figure 51:
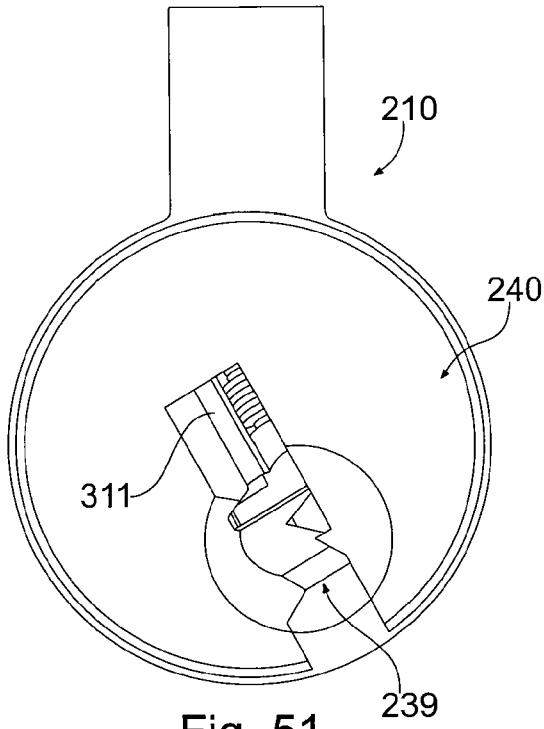
FIG. 51 is an end view of the lock cylinder assembly of FIG. 50.

Referring to FIGS. 45-47, the present embodiment of the invention utilizes two distinct types of keys, namely a user key 350 and a reset key 350'. Both keys 350, 350' include a plurality of teeth and notches 352, but the reset key 350' includes a protrusion 354 adjacent where the key shank 351' meets the key head 353. Additionally, as explained above, the shank 351 of the user key 350 is thicker compared to the shank 351' of the reset key 350' such that the user key 350 does not allow the sidebar 300 to move radially outward. Additionally, due to the thicker shank 351 of the user key 350, the key contact surface 311 will block entry of a user key 350 when the cylinder plug 240 is in the reset position as shown in FIG. 51.

Having generally described the components of the lock cylinder assembly 210, normal operation and reprogramming thereof will now be described with reference to FIGS. 37-55. The lock cylinder assembly 210 is shown in FIGS. 37 and 38 in an originally assembled configuration with each tongue pin 290 engaged with a respective rack pin 60 such that a key biting is defined for each rack pin 60. In the locked position shown, the springs 278 bias the tongue pins 290, and thereby the rack pins 60 to a lower position wherein the sidebar rail portion 282 is misaligned with the rack pin notches 64. As such, the sidebar tapered portion 284 engages the tapered groove 225 and the rack pin body portions 62 engage the housing bores 229, thereby preventing rotation of the cylinder plug 240 relative to the housing 220.

Figure 40:
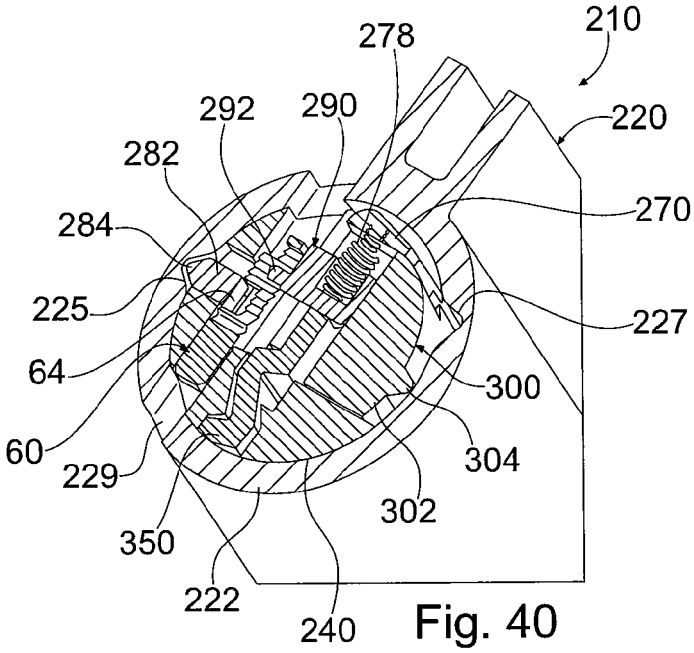
FIG. 40 is an isometric view of the lock cylinder assembly as shown in FIG. 39.

To operate the lock cylinder assembly 210 in normal operation, an appropriate user key 350 is inserted into the keyway 239 as shown in FIGS. 39 and 40. As the user key 350 is inserted, the teeth and notches 352 engage the respective tongue pins 290, thereby raising the rack pins 60 to an unlocked position wherein the notches 64 are all aligned with the sidebar rail portion 282 and the rack pin body portions 62 are disengaged from the housing bores 229.

Figure 43:
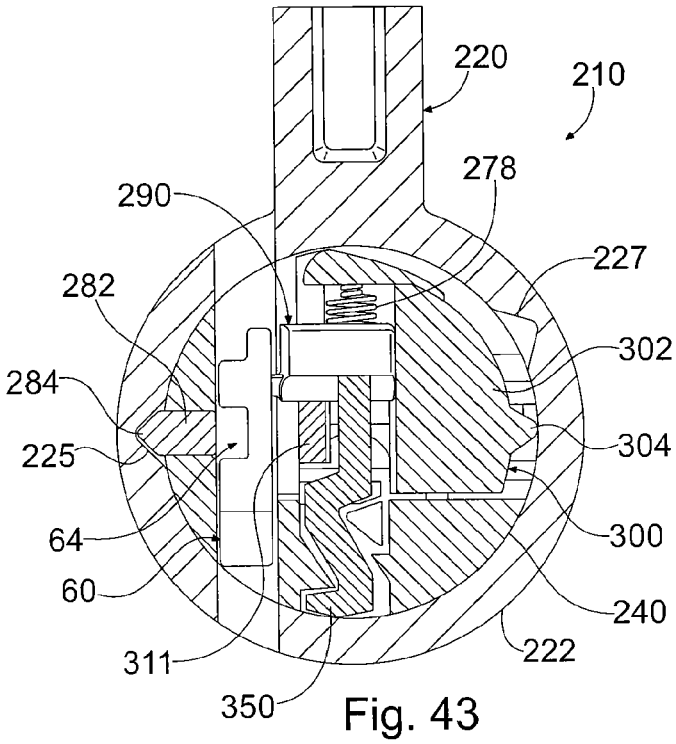
FIG. 43 is a cross-sectional view similar to FIG. 39 with a key inserted into the lock cylinder assembly.

The user then turns the user key 350 as illustrated in FIGS. 41 and 42. Since the sidebar rail portion 282 is aligned with the notches 64, the sidebar tapered portion 284 rides up the tapered groove 225 as the sidebar rail portion 282 is received in the notches 64. The plug cylinder 240 is freely rotated relative to the housing 220. As explained above, even if the plug cylinder 240 is rotated such that the tapered bar 304 is circumferentially aligned with the tapered groove 227, contact of the key contact surfaces 311 of the sidebar 300 against the shank 351 of the user key 350 prevents the sidebar 300 from moving radially outward, as shown in FIG. 43. As such, the tongue pins 290 are maintained in engagement with the rack pins 60.

Figure 44:
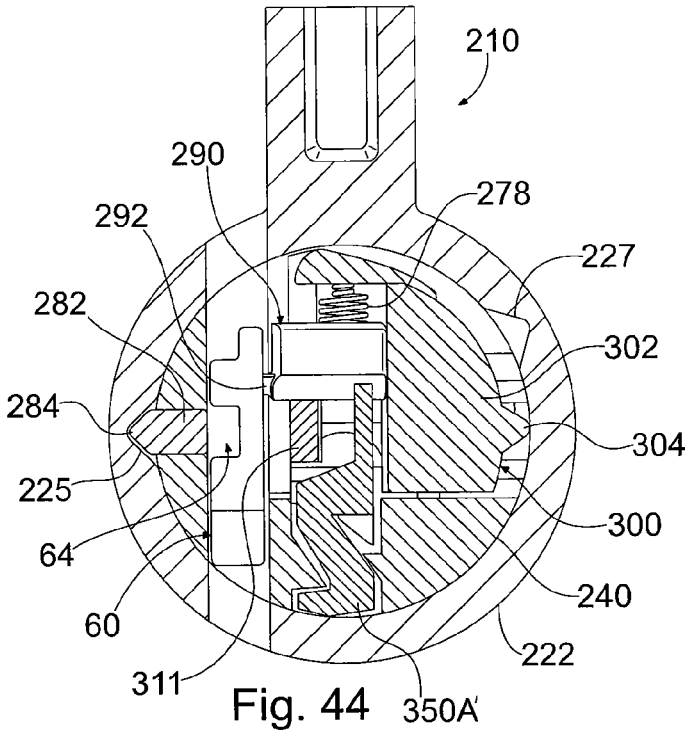
FIG. 44 is a cross-sectional view similar to FIG. 34 with a reset key inserted into the lock cylinder assembly.

If a user desires to reprogram the lock cylinder assembly 210 without disassembling the lock cylinder assembly, the user may insert a proper reset key 350' as shown in FIG. 44. As explained below, reprogramming of the lock cylinder assembly 210 requires rotation of the cylinder plug 240. As such, inserting an improper key, i.e. one not having the proper biting, will not allow reprogramming because the improper key will not properly move the rack pins 60 and the cylinder plug 240 will not be rotatable.

To reprogram the lock cylinder assembly 210, the user inserts a current reset key 350A' into the keyway. By "current", it is meant that the reset key 350A' has a tooth and notch 352 configuration which matches the currently programmed configuration of the lock cylinder assembly 210. When the current reset key 350A' is inserted, the key 350A' engages each of the tongue pins 290 and moves the respective rack pins 60 to the unlock position shown in FIG. 44 wherein each notch 64 is aligned with the sidebar rail portion 282. The current reset key 350A' is then rotated in the direction of arrow A in FIG. 48. While counterclockwise rotation is illustrated in the present embodiment, the invention is not limited to such, as illustrated above. As with normal operation, the sidebar tapered portion 284 rides up the tapered groove 225 as the sidebar rail portion 282 is received in the notches 64. Rotation of the key and cylinder plug 240 is continued until the tapered bar 304 is aligned with the tapered groove 227 in the housing 220. The springs 308 bias the re-combinating sidebar 300 radially outward as the tapered bar 304 enters the tapered groove 227. As the re-combinating sidebar 300 moves radially outward, each tongue pin 290 is also moved in the direction of arrow B in FIG. 48 such that the tongues 292 disengage from the respective engagement passages 66. The rack pins 60 stay aligned with the sidebar 280 based on the engagement of the rail portion 282 in each of the notches 64.

Figure 49:
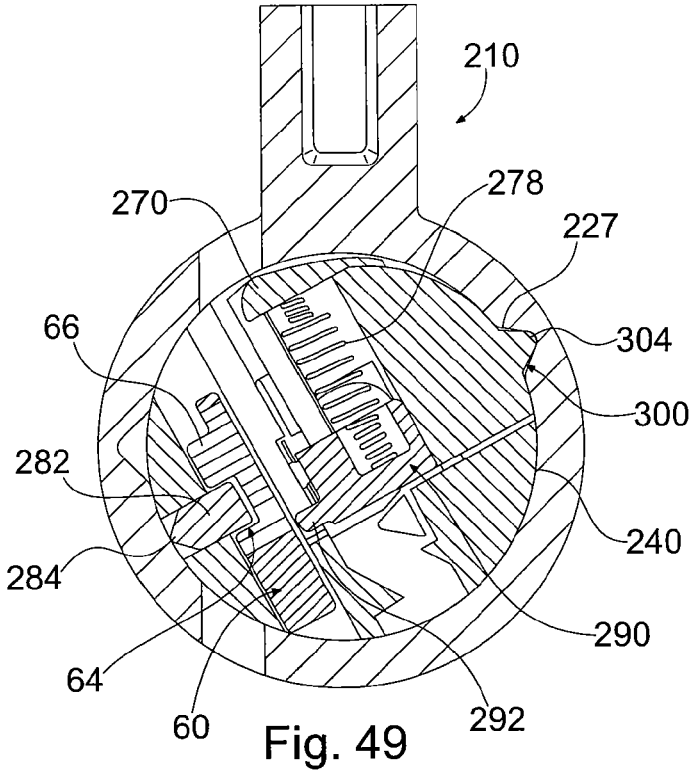
FIG. 49 is a cross-sectional view similar to FIG. 48 with the reset key removed.
Figure 52:
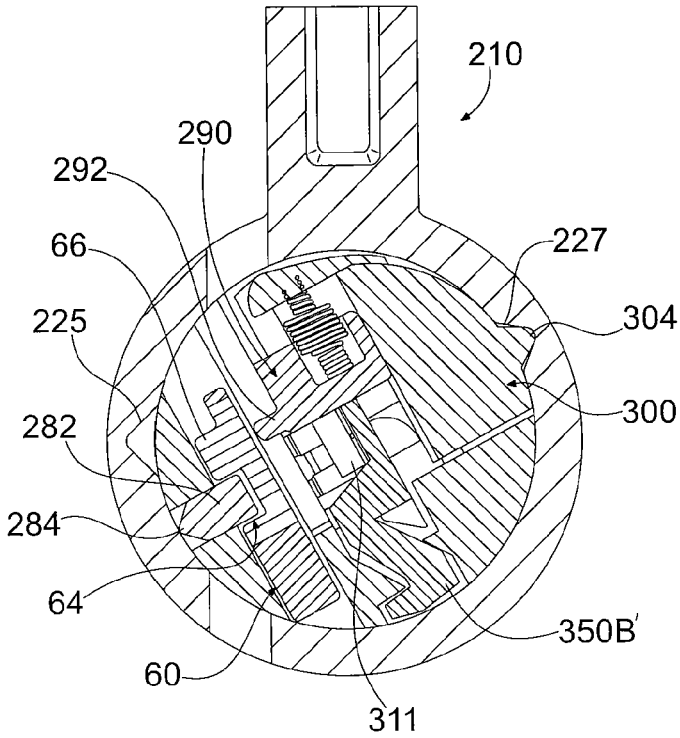
FIG. 52 is a cross-sectional view similar to FIG. 48 with a new reset key inserted into the lock cylinder assembly.

Referring to FIGS. 49 and 50, the current reset key 350A' is removed whereby the top springs 278 bias the tongue pins 290 to a lower most position wherein the tongues 292 are not aligned with any of the engagement passages 66. Additionally, as shown in FIG. 50, when the current reset key 350A' is removed, the reset actuator 320 is no longer engaged by the protrusion 354 of the reset key 350' and the spring 330 biases the reset actuator 320 such that the actuator block 326 engages the inner shoulder 305, thereby maintaining the re-combinating sidebar 300 in the radially outward, reprogram position. As explained above, a user is prevented from inserting a regular user key (non-reset key) and trying to return the cylinder plug 240 to the home position by the sidebar key contacting surfaces 311 extending within the keyway 239 as shown in FIG. 52. Additionally, because the tongues 292 do not align with any engagement passages, a user would not be able to insert an object into the keyway to try to bypass the reset actuator 320 as the tongues 292 would contact the body 62 of the rack pins 60 and prevent the re-combinating sidebar 300 from moving inward.

To complete the reprogramming, it is necessary for the user to insert a new reset key 350B' as illustrated in FIGS. 52 and 53. By "new", it is meant that the reset key 350B' has a tooth and notch 352 configuration which matches the configuration of the intended or new user key to which the lock cylinder assembly 210 is to be programmed. When the new reset key 350B' is inserted, each of the tongue pins 290 is moved to a desired position relative to a respective rack pin 60. Additionally, the protrusion 354 of the new reset key 350B' engages the actuator reset contact 324 and disengages the reset actuator block 326 from the inner shoulder 305, instead aligning the block 326 with the outer shoulder 307. Accordingly, the re-combinating sidebar 300 is free to move radially inward.

Figure 54:
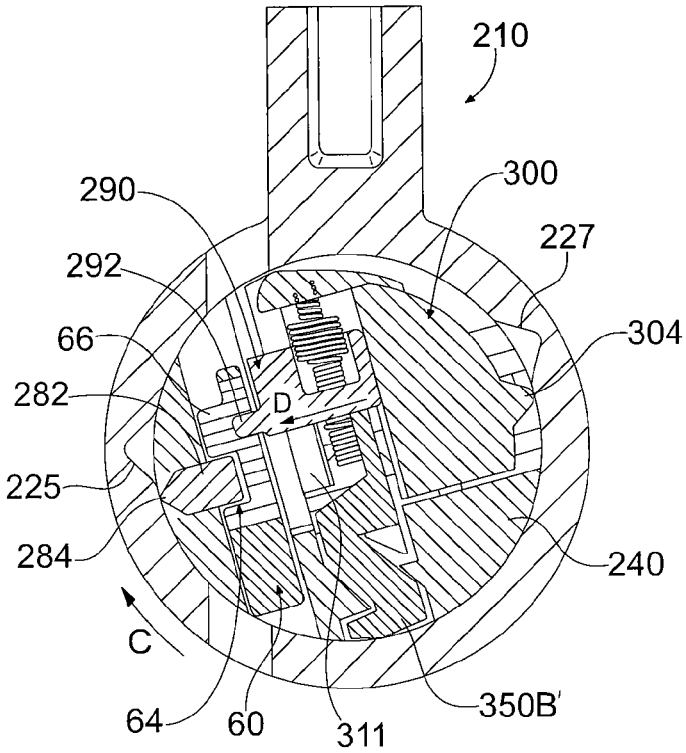
FIG. 54 is a cross-sectional view similar to FIG. 52 illustrating rotation of cylinder plug with the new reset key inserted therein from the reset position toward the home position.

The new reset key 350B' is rotated in the reverse direction, as indicated by arrow C in FIG. 54, which causes the tapered bar 304 to ride up the tapered groove 227 and move the re-combinating sidebar 300 radially inward. As the re-combinating sidebar 300 moves radially inward, the tongue pins 290 move in the direction indicated by arrow D, thereby engaging each tongue 292 with a corresponding engagement passage 66 based on new reset key 350B' tooth and notch 352 configuration.

Figure 55:
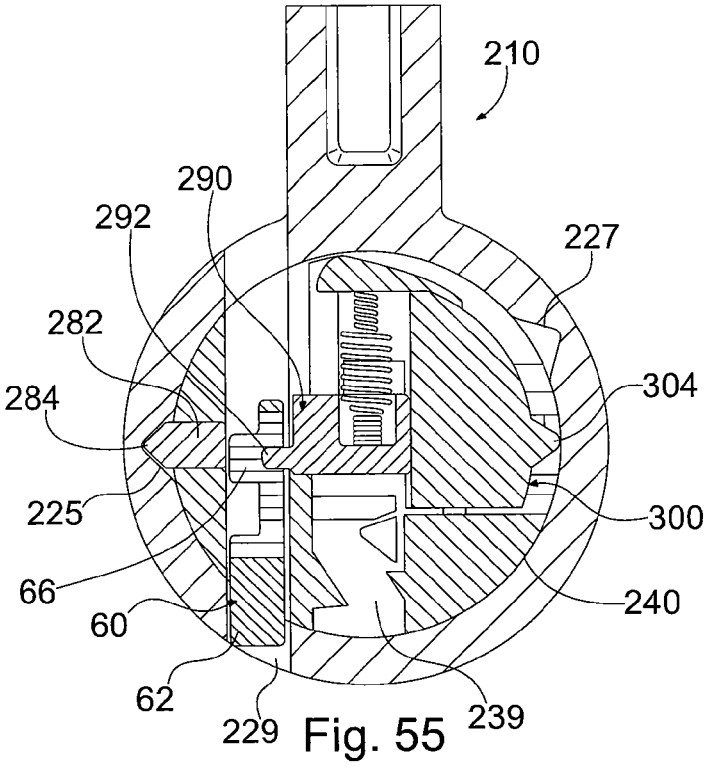
FIG. 55 is a cross-sectional view similar to FIG. 54 illustrating the reprogrammed cylinder plug in the home position with the new reset key removed.

Once the cylinder plug 240 is returned to the home position as illustrated in FIG. 55, the key 350B' is removed. Upon removal, the reset actuator 320 remains received within notch 303 against the outer shoulder 307 with the re-combinating sidebar 300 maintained in the radially inward position by contact of the tapered bar 304 against the housing inside surface 224. The reprogrammed lock cylinder assembly 210 may thereafter be operated in a normal manner with user keys 350 having the new configuration.

Referring to FIGS. 56-63, an alternative embodiment of the invention will be described. The lock cylinder assembly is substantially the same as in one of the previous embodiments, but further includes master key capability. The master key capability is achieved utilizing a master locking sidebar 80' and master rack pins 60A' and 60B', as described in more detail hereinafter. In all other respects, the lock cylinder assemblies of the present invention work in the same manner as described above.

Figure 56:
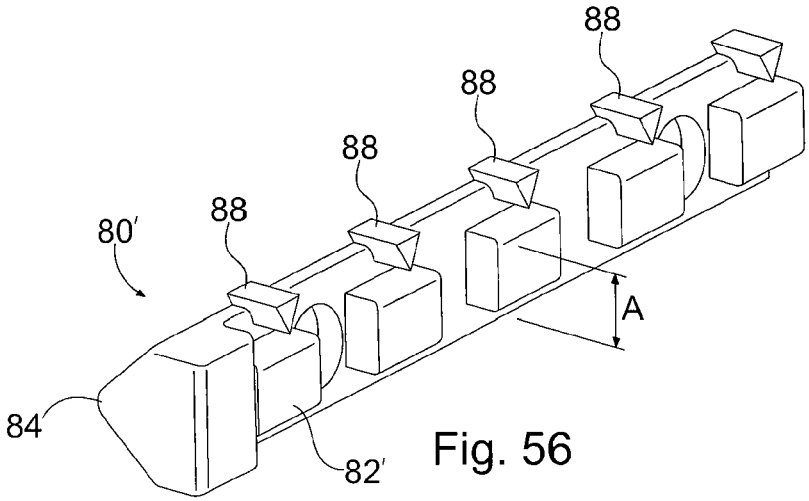
FIG. 56 is an isometric view of a locking sidebar in accordance with an alternative embodiment of the invention.

Referring to FIG. 56, the master locking sidebar 80' includes a tapered portion 84 and a rail portion 82'. In the present embodiment, the rail portion 82' is segmented rather than a continuous rail. The rail portion 82' has a height A and is configured to be received in notches 64' in the rack pins 60A' and 60B'. Master bar tongues 88 are provided along the sidebar 80' and are configured to align with the engagement passages 66' in the master rack pins 60A' and 60B'.

Figure 57:
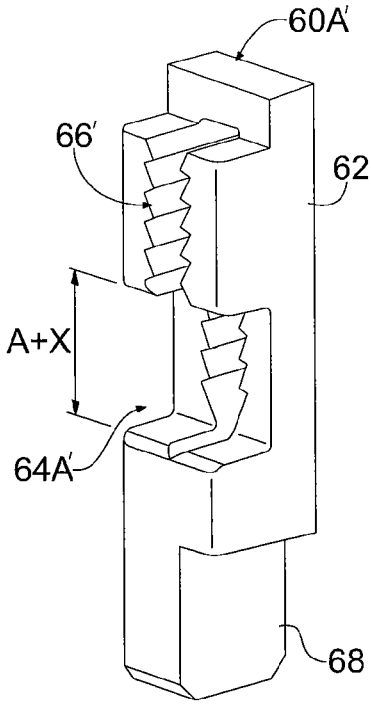
FIGS. 57 and 58 are isometric views of rack pins in accordance with alternative embodiments of the invention.
Figure 59:
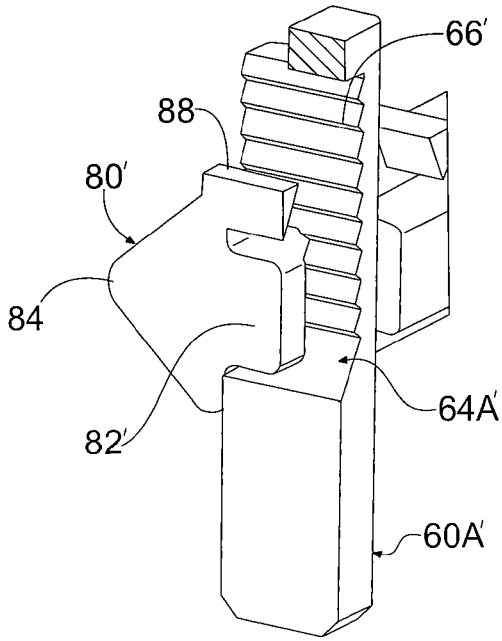
FIGS. 59-63 are isometric views illustrating engagement of the locking sidebar of FIG. 56 with the rack pins of FIGS. 57 and 58 in various positions.
Figure 60:
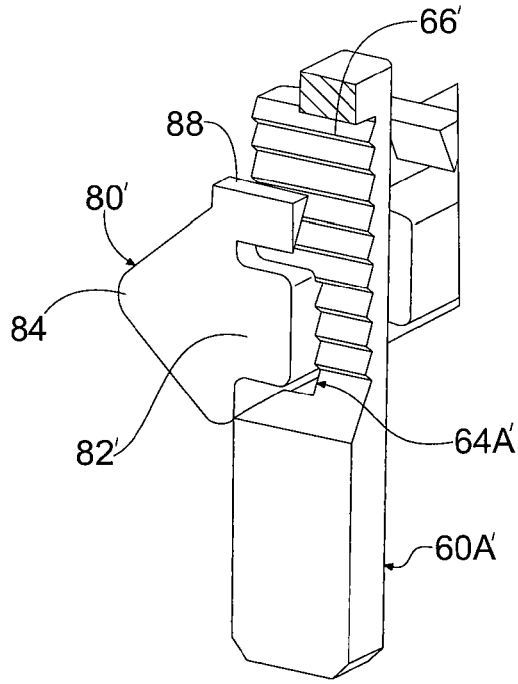

Referring to FIG. 57, master rack pin 60A' includes a body 62 with a sidebar notch 64A' configured to receive the sidebar rail portion 82'. The master rack pin 60A' also includes a series of engagement passages 66' configured to receive the tongue pin tongues 92 as in the previous embodiment and to also receive the master bar tongues 88. The height of the notch 64A' is equal to the rail portion height A plus the height X of one of the engagement passages 66'. As such, as illustrated in FIGS. 59 and 60, the rail portion 82' will be received in the notch 64' based on two different key configurations, one being one bitting away from the other.

Figure 58:
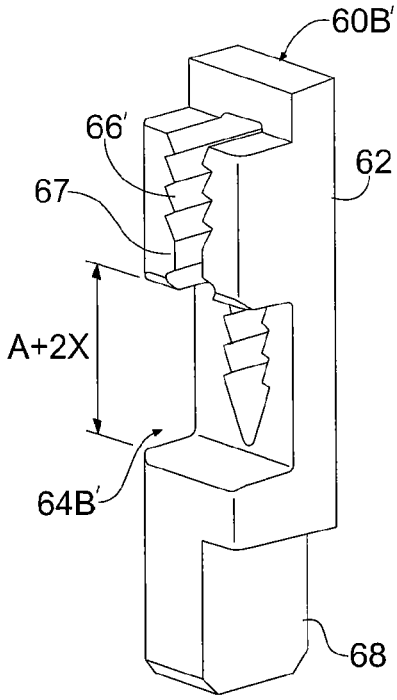
Figure 61:
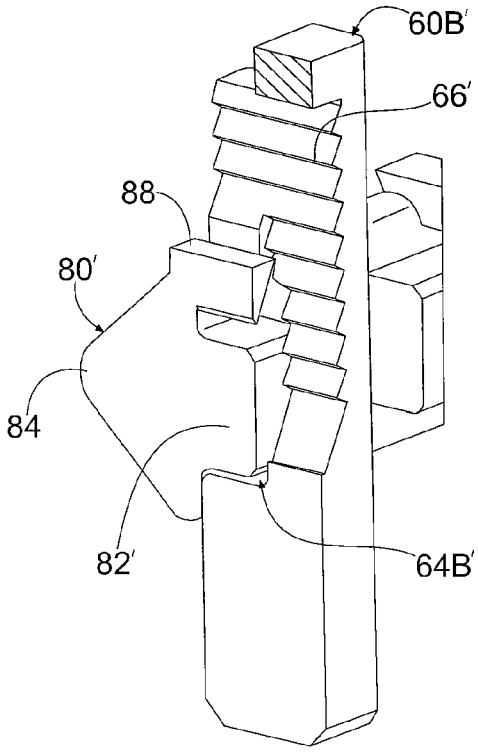
Figure 62:
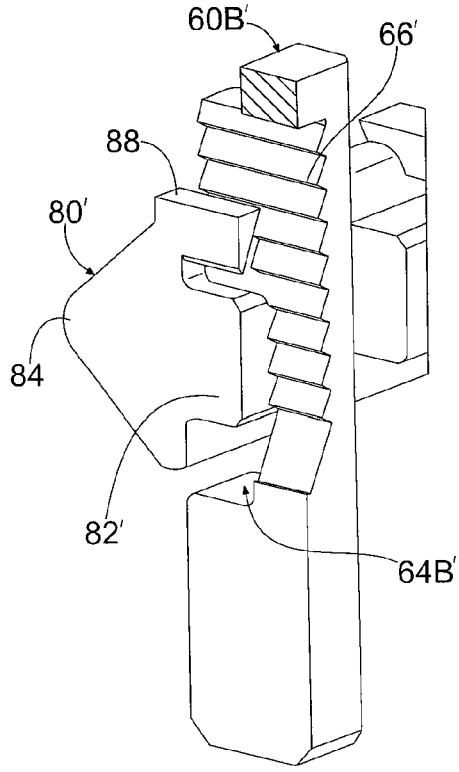
Figure 63:
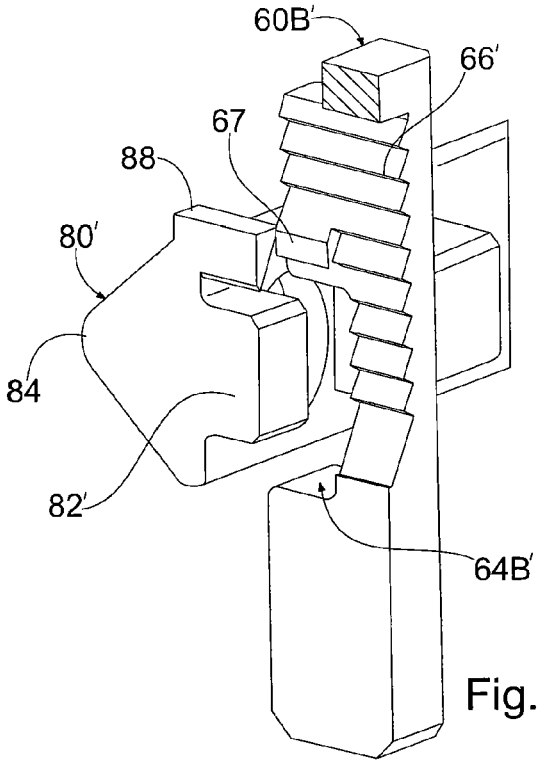

Referring to FIG. 58, master rack pin 60B' includes a body 62 with a sidebar notch 64B' configured to receive the sidebar rail portion 82'. The master rack pin 60B' also includes a series of engagement passages 66' configured to receive the tongue pin tongues 92 as in the previous embodiment and to also receive the master bar tongues 88. The height of the notch 64A' is equal to the rail portion height A plus the height 2X of two of the engagement passages 66'. However, to prevent the toothing of rack pin 60A' from also working in rack pin 60B', the passage 66' two above the notch 64B', is blocked by a blocker 67 therein. As such, as illustrated in FIGS. 61 and 62, the rail portion 82' will be received in the notch 64' based on two different key configurations, one being two bittings away from the other, however, it will not be receivable base on only one bitting difference as the master bar tongue 88 will contact the blocker 67. Other variations in the size and bitting arrangement may also be utilized.

By including various combinations of the master rack pins 60A' and 60B' in the lock cylinder assembly, such can be master keyed in various manners. An illustrative master keying system is described in U.S. Pat. No. 6,516,644 which is incorporated herein in its entirety.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A programmable lock cylinder assembly comprising:

a lock housing having a body defining a tubular opening;

a cylinder plug having a body mounted for rotation within the tubular opening, the cylinder plug including a single keyway extending therein;

a set of rack pins in the cylinder plug and moveable between a locked position wherein the cylinder plug is rotationally locked relative to the housing and an unlocked position wherein the cylinder plug is rotational relative to the housing;

a set of tongue pins in the cylinder plug extending across the single keyway, each tongue pin selectively engagable with a respective rack pin;

a re-combinating member engaged with the tongue pins and moveable between a first position wherein the tongue pins are engaged with the rack pins and a second position wherein the tongue pins are disengaged from the rack pins; and a reset actuator positioned within the cylinder plug with a portion aligned with the single keyway such that when a reset key is positioned in the single keyway it engages the reset actuator, the reset actuator moveable between an engaged position wherein the re-combinating member position is locked relative to the cylinder plug and a non-engaged position wherein the re-combinating member position is moveable relative to the cylinder plug.

2. The programmable lock cylinder assembly according to claim 1 further comprising a user key is not moveable to the second position with a user key positioned in the keyway.

3. The programmable lock cylinder assembly according to claim 2 further comprising a reset key wherein the re-combinating member is moveable to the second position only after insertion of an appropriate reset key in the keyway.

4. The programmable lock cylinder assembly according to claim 3 wherein the user key and the reset key have differing shank configurations while having the same toothing.

5. The programmable lock cylinder assembly according to claim 4 wherein the reset actuator is adjacent an inward end of the keyway and the reset key shank has a protruding tip relative to the user key shank.

6. The programmable lock cylinder assembly according to claim 5 wherein the reset actuator includes a body with a radially inner bore and a radially outer bore and wherein a pin extending from the re-combinating member is received in the radially inner bore in the first position and in the radially outer bore in the second position.

7. The programmable lock cylinder assembly according to claim 4 wherein the reset key shank has a thinner portion relative a thickness of the user key shank such that a gap is defined between the reset key shank thinner portion and a contact portion of the re-combinating member such that the re-combinating member is free to move from the first position to the second position.

8. The programmable lock cylinder assembly according to claim 7 wherein re-combinating member has a notch therein defining a radially inner shoulder and a radially outer shoulder and wherein the reset actuator is biased to engage the inner shoulder when the re-combinating member is in the second position.

9. The programmable lock cylinder assembly according to claim 8 wherein a protrusion along the reset key shank is configured to engage the reset actuator and move the reset actuator into axial alignment with the outer shoulder such that the re-combinating member may move radially inward.

10. The programmable lock cylinder assembly according to claim 3 wherein a portion of the re-combinating member blocks a portion of the keyway when the re-combinating member is in the second position such that keyway has a narrowed configuration which the user key is unable to pass through.

11. The programmable lock cylinder assembly according to claim 1 wherein each tongue pin includes a body with a notch therein configured to receive a corresponding post extending from the re-combinating member and thereby guiding axial movement of the respective tongue pin.

12. The programmable lock cylinder assembly according to claim 1 wherein each tongue pin includes a circular body portion and the re-combinating member includes a plurality of bores, each bore configured to receive a respective circular body portion and thereby guide axial movement of the respective tongue pin.

13. The programmable lock cylinder assembly according to claim 1 wherein each rack pin includes a series of passages and each tongue pin includes a tongue configured to be received in the passages.

14. The programmable lock cylinder assembly according to claim 13 wherein the passages have a serrated configuration and the tongues have a corresponding inverted triangular configuration.

15. The programmable lock cylinder assembly according to claim 1 wherein each of the tongue pins is biased toward a lower most position relative to the keyway.

16. The programmable lock cylinder assembly according to claim 1 wherein the set of rack pins includes at least a first subset of rack pins and a second subset of rack pins, the first subset of rack pins having at least two operable bitting configurations and the second subset of rack pins having a different bitting configuration such that the lock cylinder assembly is master keyable.

17. The programmable lock cylinder assembly according to claim 16 wherein the first set of rack pins each having a sidebar notch of a first configuration and the second set of rack pins each having a sidebar notch of a second, different configuration.

18. The programmable lock cylinder assembly according to claim 17 wherein each rack pin includes a series of passages and each tongue pin includes a tongue configured to be received in the passages.

19. The programmable lock cylinder assembly according to claim 18 further comprising a sidebar having a portion configured to be received in the sidebar notches and a plurality of protrusions configured to be received in respective ones of the rack pin passages.

20. A method of resetting a programmable lock cylinder assembly comprising a lock housing having a body defining a tubular opening and a cylinder plug having a body mounted for rotation within the tubular opening, the cylinder plug including a keyway extending therein, comprising the steps of:

inserting a first reset key into the keyway which contacts a plurality of tongue pins in the cylinder plug extending across the keyway such that each tongue pin is moved to an unlock position wherein a respective rack pin engaged thereby is also moved to an unlocked position wherein the cylinder plug is rotational relative to the housing, the reset key also contacting an actuator member within the cylinder plug, the actuator member extending across the keyway;

rotating the cylinder plug until a re-combinating member engaged with the tongue pins moves within the lock housing from a first position wherein the tongue pins are engaged with the rack pins to a second position wherein the tongue pins are disengaged from the rack pins;

removing the first reset key wherein the actuator member maintains the re-combinating member in the second position and each of the tongue pins moves to a default position;

inserting a second reset key into the keyway whereby each tongue is moved to a reset unlock position and the second reset key engages the actuator member;

rotating the cylinder plug to a home position wherein the re-combinating member moves to the first position; and removing the second reset key.

21. The method of claim 20 wherein the reset actuator engages the re-combinating member and prevents it moving from the first position to the second position until an appropriate reset key is inserted in the keyway.

22. The method of claim 20 wherein a portion of the re-combinating member blocks a portion of the keyway when the re-combinating member is in the second position.

23. A programmable lock cylinder assembly comprising:

a lock housing having a body defining a tubular opening;

a cylinder plug having a body mounted for rotation within the tubular opening, the cylinder plug including a keyway extending therein;

a set of rack pins in the cylinder plug and moveable between a locked position wherein the cylinder plug is rotationally locked relative to the housing and an unlocked position wherein the cylinder plug is rotational relative to the housing;

a set of tongue pins in the cylinder plug extending across the keyway, each tongue pin selectively engagable with a respective rack pin;

a re-combinating member engaged with the tongue pins and moveable between a first position wherein the tongue pins are engaged with the rack pins and a second position wherein the tongue pins are disengaged from the rack pins; and a reset actuator positioned within the cylinder plug with a portion aligned with the keyway such that when a reset key is positioned in the keyway it engages the reset actuator, the reset actuator moveable between an engaged position wherein the re-combinating member position is locked relative to the cylinder plug and a non-engaged position wherein the re-combinating member position is moveable relative to the cylinder plug, wherein the reset actuator includes a body with a radially inner bore and a radially outer bore and wherein a pin extending from the re-combinating member is received in the radially inner bore in the first position and in the radially outer bore in the second position.

* * * * *